US010175625B2

(12) United States Patent
Yoshimura et al.

(10) Patent No.: US 10,175,625 B2
(45) Date of Patent: Jan. 8, 2019

(54) SHEET CONVEYING APPARATUS WHICH CAN DETECT THICKNESS OF SHEETS

(71) Applicant: KONICA MINOLTA, INC., Chiyoda-ku, Tokyo (JP)

(72) Inventors: Kazutoshi Yoshimura, Toyokawashi (JP); Takashi Watanabe, Toyokawashi (JP); Akinori Kimata, Toyokawashi (JP); Shiro Umeda, Toyokawashi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/267,293

(22) Filed: Sep. 16, 2016

(65) Prior Publication Data

US 2017/0075278 A1 Mar. 16, 2017

(30) Foreign Application Priority Data

Sep. 16, 2015 (JP) ..... 2015-183436

(51) Int. Cl.
*G03G 15/00* (2006.01)

(52) U.S. Cl.
CPC ..... *G03G 15/607* (2013.01); *G03G 15/602* (2013.01); *G03G 2215/00333* (2013.01)

(58) Field of Classification Search
CPC ..... B65H 2220/01; B65H 2220/02; B65H 2220/03; B65H 2511/13
See application file for complete search history.

(56) References Cited

U.S. PATENT DOCUMENTS 5,927,703 A * 7/1999 Endo ..... B65H 3/06 271/10.03
6,189,879 B1 * 2/2001 Conner ..... B65H 7/125 270/52.06
9,749,486 B2 * 8/2017 Yoshimizu ..... H04N 1/00774
2006/0056861 A1 * 3/2006 Nojima ..... G03G 15/6564 399/16
2006/0098074 A1 * 5/2006 Nakashima ..... B41J 11/007 347/104

(Continued)

FOREIGN PATENT DOCUMENTS

JP 05-294512 A 11/1993
JP H09-101722 A 4/1997

(Continued)

OTHER PUBLICATIONS

Mizuno JP 05-294512 Machine Translation.*

(Continued)

*Primary Examiner* — David Banh
(74) *Attorney, Agent, or Firm* — Buchanan Ingersoll & Rooney PC

(57) ABSTRACT

A sheet conveying apparatus has a reference roller, a detection roller, and a detection sensor. The detection roller can move, and makes contact with the reference roller, facing the reference roller. The detection sensor outputs a signal corresponding to the displacement of the detection roller. The sheet is conveyed to a nip portion of the pair of rollers. At this time, the timing when an edge portion of the sheet being conveyed passes through the nip portion is detected. In response to the timing detected, the thickness of the sheet is detected, based on the signal output from the detection sensor.

20 Claims, 18 Drawing Sheets

(56) References Cited

U.S. PATENT DOCUMENTS

2007/0171488 A1* 7/2007 Chen ..... H04N 1/00681 358/498
2007/0234582 A1 10/2007 Kondo
2008/0148968 A1* 6/2008 Takahashi ..... B41L 13/06 101/118
2011/0058827 A1* 3/2011 Maehata ..... G03G 15/0131 399/39
2011/0058829 A1* 3/2011 Kondo ..... G03G 15/5029 399/45
2014/0015192 A1* 1/2014 Wakabayashi ..... B65H 7/12 271/110
2014/0309958 A1* 10/2014 Luo ..... G07D 7/164 702/88
2015/0002574 A1* 1/2015 Abe ..... B41J 11/00 347/16
2015/0115947 A1* 4/2015 Yanagiuchi ..... G07D 7/04 324/244
2015/0239695 A1* 8/2015 Noda ..... B65H 7/14 271/265.01
2015/0356806 A1* 12/2015 Xie ..... B65H 7/02 271/265.04
2016/0139554 A1* 5/2016 Yoshimizu ..... B65H 7/02 399/367

FOREIGN PATENT DOCUMENTS

JP 2011-079665 A 4/2011
JP 2012-030937 A 2/2012
JP 2012-173553 A 9/2012

OTHER PUBLICATIONS

Office Action (Notification of Reasons for Refusal) dated Oct. 24, 2017 by the Japanese Patent Office in corresponding Japanese Patent Application No. 2015-183436 and English Translation of the Office Action. (9 pages).

Office Action dated Jan. 2, 2018 by the State Intellectual Property Office of People's Republic of China in corresponding Chinese Patent Application No. 201610825759.2 and an English Translation of the Office Action. (22 pages).

* cited by examiner

SHEET CONVEYING APPARATUS WHICH CAN DETECT THICKNESS OF SHEETS

This application is based on Japanese Patent Application No. 2015-183436 filed with the Japan Patent Office on Sep. 16, 2015, the entire content of which is hereby incorporated by reference.

BACKGROUND OF THE INVENTION

Field of the Invention

This invention relates to a sheet conveying apparatus, an image forming apparatus, a control method of a sheet conveying apparatus, and a control program of a sheet conveying apparatus. In particular, this invention relates to a sheet conveying apparatus, an image forming apparatus, a control method of a sheet conveying apparatus, and a control program of a sheet conveying apparatus, which can detect thickness of sheets.

Description of the Related Art

When paper sheets are manually set to feed them into an image forming apparatus, a user may not comprehend the thickness of the sheets to be used. In case that image forming behavior is performed based on an incorrect configuration of the thickness of the sheets, there is the potential for the occurrence of a sheet jam, or the occurrence of the problem in transferring images to the sheets or image fixing performance. To cope with these problems, a thickness of the sheet to be conveyed by a sheet conveying apparatus is detected (sheet thickness detection), for preventing the printing failure and for improving users' convenience.

To detect sheet thickness, a sheet thickness detection method using the amount of displacement of a detection roller, when a sheet is pinched between a reference roller and the detection roller is typically used. Such a method has a problem in which the detection result varies, since the amount of displacement of the detection roller includes an amount of displacement caused by an eccentricity of the roller, in response to a rotation cycle. Because of the problem, the desired degree of detection accuracy can not be obtained.

FIG. 18 is for explanation pertaining to a conventional detection method.

In FIG. 18, the upper part shows the amount of displacement of detection roller 810, when sheet P is not pinched between reference roller 805 and detection roller 810, and the lower part shows the amount of displacement of detection roller 810, when sheet P is pinched between reference roller 805 and detection roller 810. Both when sheet P is not pinched and sheet P is pinched, the amount of displacement of the detection roller 810 periodically fluctuates, in accordance with the rotation of reference roller 805 and detection roller 810.

More specifically, where the diameter of detection roller 810 is represented by D, and the conveying velocity of sheet P is represented by S, rotation cycle C of detection roller 810 is calculated by $D*\pi/S$. When sheet P is not pinched, the amount of displacement of detection roller 810 periodically fluctuates for each rotation cycle C. The periodical fluctuation is caused by the eccentricity or the like of detection roller 810 and reference roller 805. When sheet P is pinched, the periodical fluctuation is still included in the entire amount of displacement, though the level of the amount of displacement of detection roller 810 rises by the thickness of the sheet. Hence, the detection result varies based on the detection timing.

As for such the problem, there are conventional techniques which adopt the following structures.

In the Document 1 below, the detection of the correct sheet thickness is attempted, by performing memorizing, calculating and compensating behavior for the eccentricity amount of the reference roller. More specifically, displacement signals of the detection roller within a certain period of time are recorded, after a sheet is entered between the reference roller and the detection roller. A calculation is executed between the displacement signal of the detection roller when a certain period of time which is the integral multiple of a rotation cycle of the reference roller has elapsed from when the sheet was entered, and the recorded displacement signal. Herewith, the eccentricity amount of the reference roller is corrected, for the recorded displacement signal.

According to the Document 2 below, thickness of a sheet is calculated, by using variation data during more than or equal to a rotation cycle of a roller for sheet thickness detection when the sheet is pinched and when the sheet is not pinched.

According to the Document 3 below, thickness of a sheet is calculated upon synchronizing an amount of displacement of a detection roller when a sheet is not pinched, with an amount of displacement of the detection roller when the sheet is pinched, after detection of a rotation cycle of the roller.

DOCUMENTS

[Document 1] Japan Patent Publication No. (HEI) 5-294512

[Document 2] Japan Patent Publication No. 2011-079665

[Document 3] Japan Patent Publication No. 2012-030937

However, the methods disclosed in the above-mentioned Documents 1 to 3 have the following problem. According to the methods, variation data during more than or equal to one rotation cycle when a sheet is pinched by a roller for sheet thickness detection, and variation data during more than or equal to one revolution when a sheet is not pinched, are used. To calculate sheet thickness by using the variation data, the variation data should be acquired until the roller rotates one revolution. In addition, the dedicated calculation algorithm for calculating sheet thickness should be prepared, to execute the calculation. Further, the variation data should be recorded in a storage device. Hence, a structure of the sheet conveying apparatus may become complex. The manufacturing cost of the sheet conveying apparatus may become higher.

This invention is to solve the above problems. The object of this invention is to provide a sheet conveying apparatus, an image forming apparatus, a control method of a sheet conveying apparatus, and a control program of a sheet conveying apparatus, which can detect thickness of a sheet with a high degree of accuracy, by employing simple structure.

SUMMARY OF THE INVENTION

To solve the above problems, a sheet conveying apparatus according to the invention comprises: a pair of rollers including a reference roller and a detection roller, wherein the detection roller can move and faces and makes contact with the reference roller, a detection sensor for outputting a signal corresponding to displacement of the detection roller, a conveying unit for conveying a sheet to a nip portion of the pair of rollers, a timing detection unit for detecting timing when an edge portion of the sheet which is conveyed by the conveying unit passes through the nip portion, and a thickness detection unit for detecting a thickness of the sheet, in response to the timing detected by the timing detection unit, based on the signal output from the detection sensor.

DESCRIPTION OF THE PREFERRED EMBODIMENTS

An image forming apparatus according to the embodiment of this invention will be explained in the followings.

The image forming apparatus is an MFP (Multi Function Peripheral) which has a scanner function, a copying function, a function of a printer, a facsimile function, a data transmitting function, and a server function. The scanner function is to read images of documents being set, and accumulate them in a HDD (Hard Disk Drive) or the like. The copying function is to print (printing) them on sheets or the like. The function of a printer is to execute printing on sheets, based on instructions, when receiving the instructions from an external terminal, for example, a PC or the like. The facsimile function is to receive facsimile data from an external facsimile device or the like, and accumulate it in the HDD or the like. The data transmitting function is to transmit data to connected external devices and receive data from connected external devices. The server function is to make data being stored in a HDD or the like sharable among a plurality of users.

The image forming apparatus is equipped with a sheet conveying apparatus. The sheet conveying apparatus conveys a sheet, and can detect the thickness of the sheet.

The First Embodiment

Figure 1:
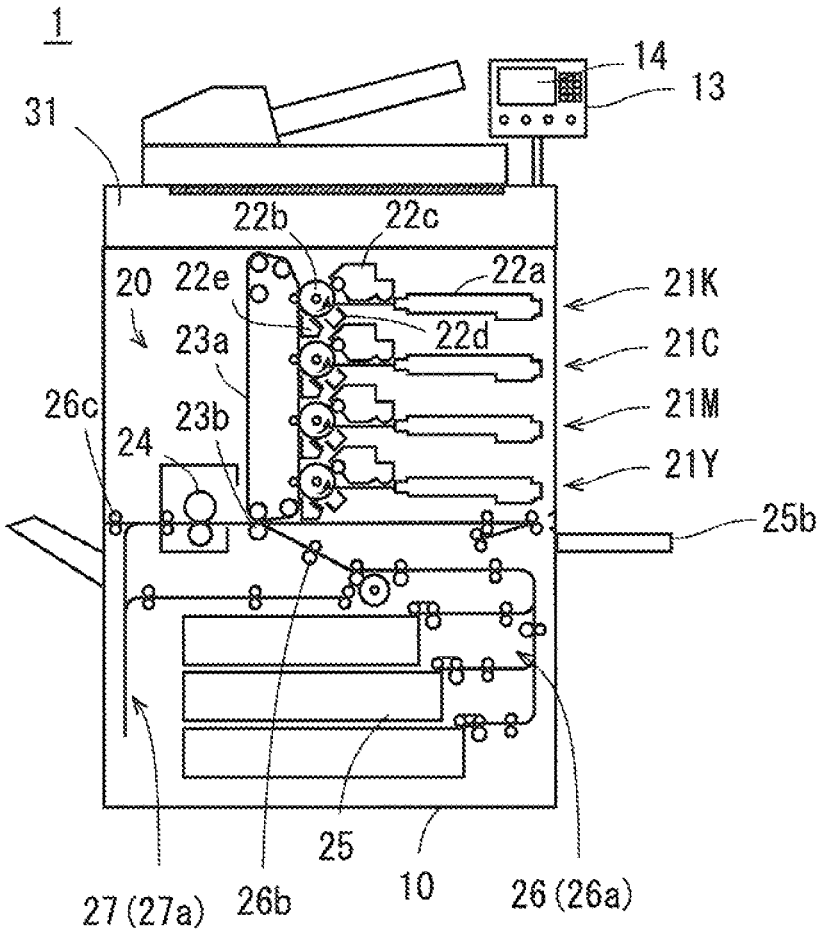
FIG. 1 shows an outlined structure of an image forming apparatus in the first embodiment of this invention.

FIG. 1 shows an outlined structure of an image forming apparatus in the first embodiment of this invention.

As shown in FIG. 1, image forming apparatus 1 is equipped with main body 10 which includes image forming unit 20, and scanner unit (an example of a document reading device) 31. Main body 10 is provided with conveying unit 26. Conveying unit 26 conveys sheets which were fed from paper feeding tray 25 or manual paper feeding tray 25*b* to image forming unit 20, along with the sheet conveying path. Conveying unit 26 has a plurality of conveying rollers 26*a*. Conveying rollers 26*a* are provided at a plurality of locations in the sheet conveying path. Conveying rollers 26*a* include register roller 26*b*, paper ejection roller 26*c*, and so on.

Figure 2:
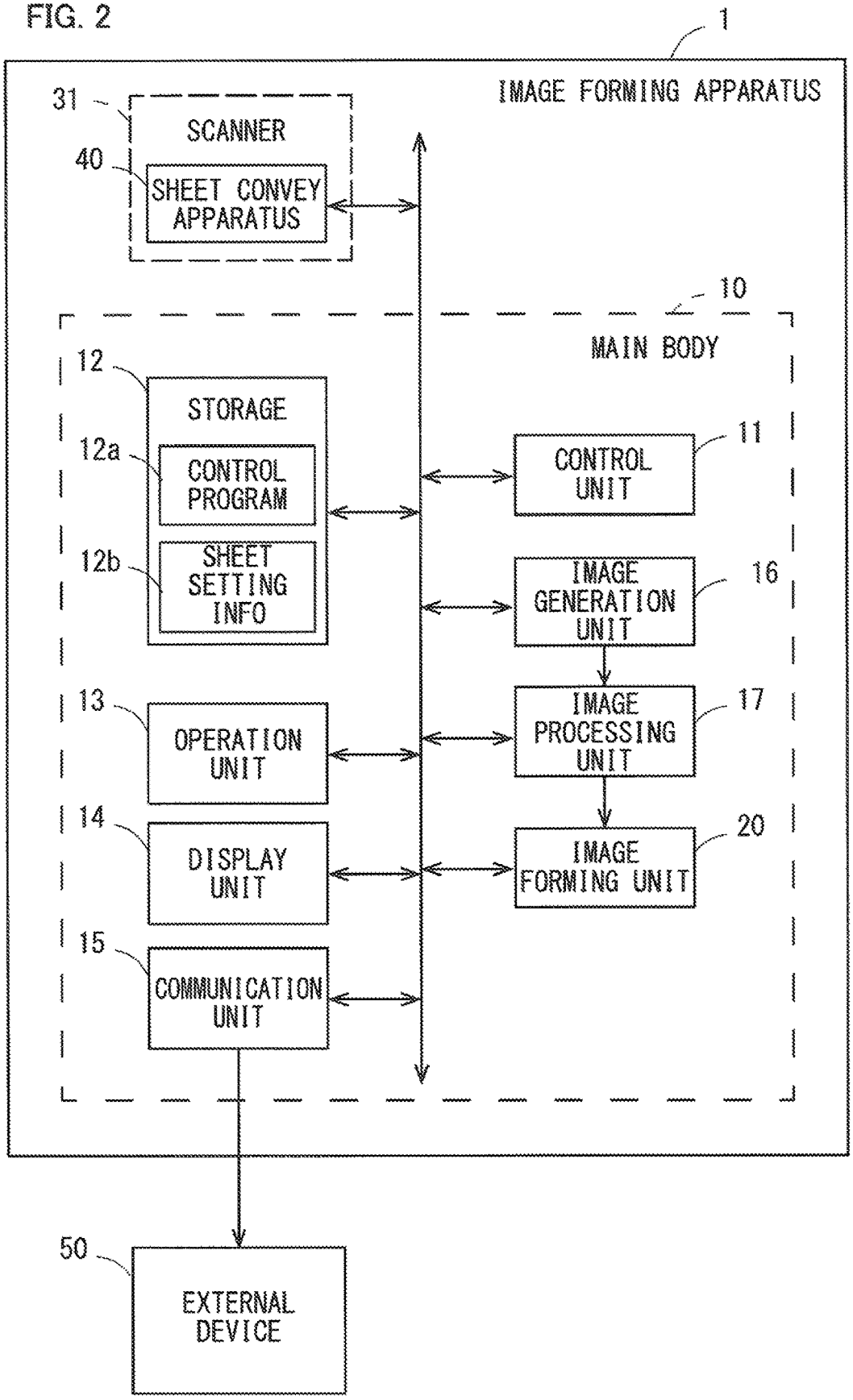
FIG. 2 shows a function block diagram of the image forming apparatus.

FIG. 2 shows a function block diagram of the image forming apparatus 1.

In FIG. 2, main structures of image forming apparatus 1 are illustrated for each function.

As shown in FIG. 2, main body 10 is equipped with control unit 11, storage unit 12, operation unit 13, display unit 14, communication unit 15, image generation unit 16, image processing unit 17, and image forming unit 20. Main body 10 is connected with external device 50 on a network. Main body 10 can communicate with external device 50 via communication unit 15.

Control unit 11 reads out control program 12*a* stored in storage unit 12. Control unit 11 controls main body 10 and scanner unit 31 by executing control program 12*a* read out. Control unit 11 can be formed with a CPU (Central Processing Unit), a RAM (Random Access Memory), and so on.

For example, control unit 11 processes images generated by image generation unit 16, using image processing unit 17. Control unit 11 forms images on a sheet by using image forming unit 20, based on gradation values of image pixels after image processing.

Storage unit 12 stores control program 12*a* and data, for example, sheet setting information 12*b* which is used when control program 12*a* is executed. The control program 12*a* and the information can be read out by control unit 11. Sheet setting information 12*b* is data used for image forming behavior of the image forming unit 20, for example.

As storage unit 12, a large capacity memory, for example, a hard disk drive can be employed.

As shown in FIG. 1, operation unit 13 and display unit 14 are provided as user interfaces of main body 10.

Operation unit 13 generates operation signals corresponding to operations of the user. Operation unit 13 outputs the generated operation signals to control unit 11. Operation unit 13 is configured with keys or a touch panel, for example. The touch panel is configured, integrated with display unit 14.

Display unit 14 displays an operation screen or the like, in accordance with instructions from control unit 11. As display unit 14, an LCD (Liquid Crystal Display), an OELD (Organic Electro Luminescence Display), or the like can be employed.

As shown in FIG. 2, communication unit 15 communicates with external device 50 on a network. External device 50 is, for example, a user terminal, a server, another image forming apparatus, or the like.

Communication unit 15 receives data via network from external device 50 as a user terminal, for example. Communication unit 15 receives PDL data described in a page-description language (PDL: Page Description Language).

Image generation unit 16 rasterizes the PDL data received via communication unit 15, to generate images. The images are bit map formatted images, which have gradation values for pixels. Image generation unit 16 generates images for colors of C (cyan), M (magenta), Y (yellow) and K (black). The gradation values are data values which represent grayscales of images. For example, an 8-bit data value represents a grayscale of a gradation of 0 to 255.

Image generation unit 16 acquires colored images of R (red), G (green) and B (blue), by reading documents by using scanner unit 31. Image generation unit 16 can generate colored images of C, M, Y and K, by converting colors of each colored image.

Image processing unit 17 processes images which were generated by image generation unit 16. The image processing is, for example, a gradation process, or a halftone process.

In the gradation process, gradation values of pixels in images are converted to corrected gradation values. The correction is to adjust the density characteristic of images formed on a sheet to a target density characteristic.

The halftone process is, for example, an error diffusion process, a screen process using a systematic dither method.

Image forming unit 20 forms an image which consists of a plurality of colors on a sheet, based on gradation values of pixels of the image processed by image processing unit 17.

As shown in FIG. 1, image forming unit 20 is equipped with four writing units 21 (21Y, 21M, 21C and 21K), secondary transfer belt 23*a*, secondary transfer roller 23*b*, fixing device 24, and paper feeding tray 25. Writing units 21 are placed along with a belt surface of secondary transfer belt 23*a*, in series. Secondary transfer belt 23*a* rotates by the action of a plurality of rollers. One of the pluralities of rollers configures the secondary transfer roller 23*b*.

In addition to conveying unit 26 which conveys sheets from paper feeding tray 25, the image forming unit 20 has reverse mechanism 27. Conveying unit 26 has conveying rollers 26*a* installed at a plurality of locations on the sheet conveying path. Paper feeding tray 25 stores sheets. Conveying unit 26 conveys sheets from paper feeding tray 25, by using the plurality of conveying rollers 26*a*. On the sheet conveying path, secondary transfer roller 23*b*, fixing device 24, and so on are placed.

Four writing units 21C, 21M, 21Y and 21K form colored images of C, M, Y and K respectively. The structures of writing units 21 are the same. More specifically, one of writing units 21 is equipped with expose unit 22*a*, photo conductor 22*b*, developping unit 22*c*, electrostatic charging unit 22*d* and cleaning unit 22*e*.

Each of writing units 21 forms each colored image, as follows. More specifically, electrostatic charging unit 22*d* applies electrical voltage onto photo conductor 22*b*, so that photo conductor 22*b* gets electrostatic charged. Expose unit 22*a* irradiates photo conductor 22*b* with laser beams in response to gradation values of pixels of each colored image of C, M, Y or K, to expose photo conductor 22*b*. Developping unit 22*c* supplies color material, as exemplified by toner, to photo conductor 22*b*, so that an electrostatic latent image formed on photo conductor 22*b* is developed. Then, each colored image is formed on photo conductor 22*b* in each of writing units 21.

The images on photo conductors 22*b* are transferred onto secondary transfer belt 23*a* to overlap the images in series, so that an image which consists of a plurality of colors is formed on secondary transfer belt 23*a*. After the transferring of the images onto secondary transfer belt 23*a*, each of writing units 21 removes residual color materials on photo conductor 22*b*, by using cleaning unit 22*e*.

Sheets are fed by paper feeding trays 25. Sheets are conveyed along with a sheet conveying path by conveying unit 26. Secondary transfer roller 23*b* transfers an image, which consists of a plurality of colors on secondary transfer belt 23*a*, onto a sheet. The sheet is conveyed to fixing device 24. Fixing device 24 heats and applies pressure on the sheet. Herewith, the image is fixed to the sheet. After that, the sheet is discharged from main body 10, by discharge roller 26*c*.

When forming images on both side of a sheet, after an image was fixed, the sheet is conveyed to reverse mechanism 27. Reverse mechanism 27 has conveying roller 27*a* and so on. Reverse mechanism 27 reverses the side of the sheet by using conveying roller 27*a*, and conveys the sheet to secondary transfer roller 23*b* again. Herewith, an image is formed on the reverse side of the sheet.

Figure 3:
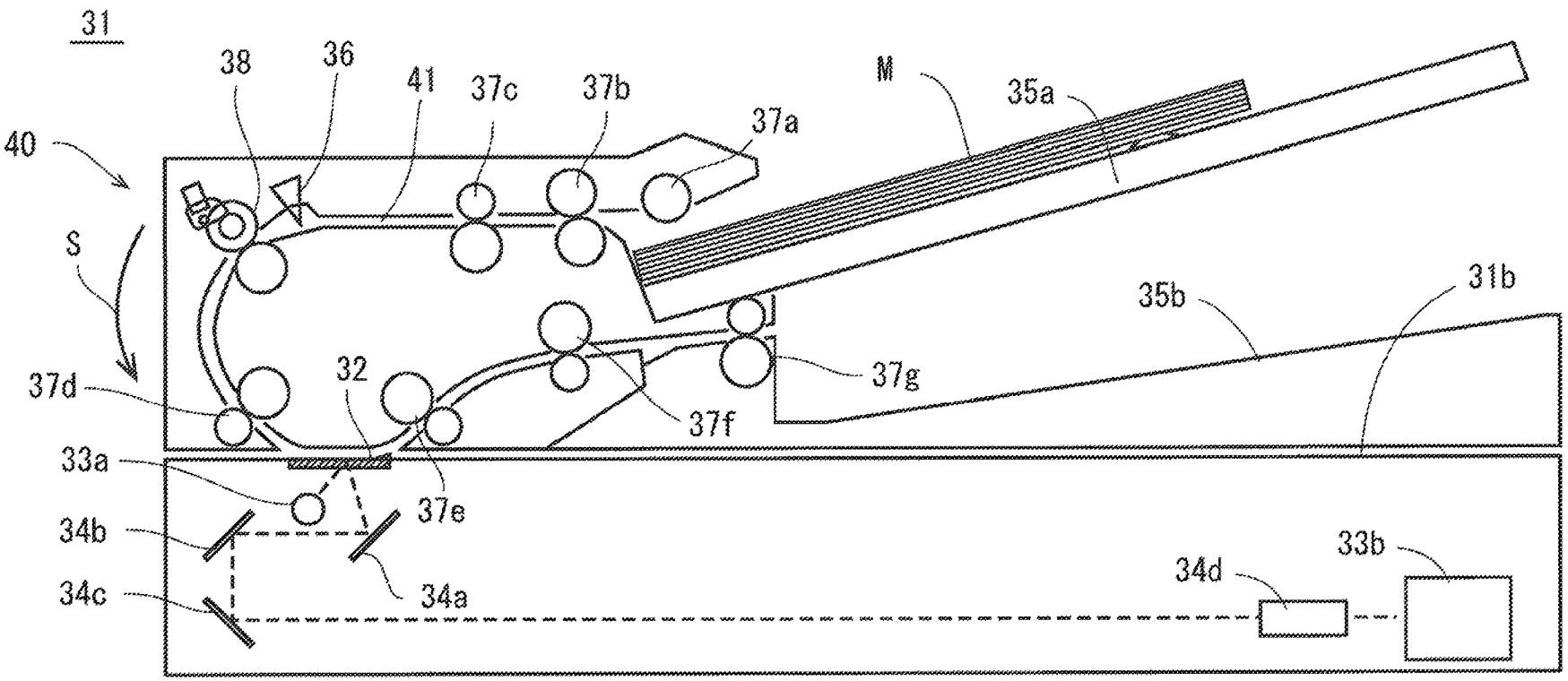
FIG. 3 shows an outlined structure of a scanner unit.

FIG. 3 shows an outlined structure of a scanner unit 31.

As shown in FIG. 3, scanner unit 31 has sheet conveying apparatus 40 which is an ADF (auto document feeder). Scanner unit 31 can read a document placed on platen 31*b*, and read documents by using sheet conveying apparatus 40.

Scanner unit 31 reads document M which is being conveyed, as an image, while making document M and contact glass 32 close to each other. Scanner unit 31 can read sheets on which images were formed by image forming unit 20. In that case, a user places sheets output from image forming apparatus 1, on document mounting table 35*a*, to execute reading.

In the inner part of the scanner main body, light source 33*a*, image sensor 33*b*, mirrors 34*a*, 34*b* and 34*c*, and lens 34*d* are placed. Image sensor 33*b* is a CCD, for example. When light is emitted from light source 33*a*, the light reflects at the surface of document M (the surface facing downward in FIG. 3). The reflected light is reflected by mirrors 34*a* to 34*c* and enters image sensor 33*b*. During document M is being conveyed, the reflected light is read by image sensor 33*b*. By doing that, an image of the surface of document M is read.

In scanner unit 31, document mounting table 35*a* and document receiving tray 35*b* are provided. On document mounting table 35*a*, documents M to be conveyed into the inner part of scanner unit 31 and be read are stacked. Document M which was read is discharged from the inner part of scanner unit 31 onto document receiving tray 35*b*.

In the inner part of scanner unit 31, sheet conveying path 41 which connects document mounting table 35*a* and document receiving tray 35*b* is provided. Sheet conveying apparatus 40 has a plurality of conveying rollers 37*a* to 37*g* and 38 installed along with conveying path 41 (hereinafter, they may not be distinguished and may be referred to as conveying rollers 37) (an example of a conveying unit).

Conveying rollers 37 are driven by a plurality of paper feeding conveying motors (which are not shown in the figures). For example, a paper feeding motor (which is not shown in the figures) drives pick roller 37*a* and paper feeding roller 37*b* via a clutch (which is not shown in the figures). Pick roller 37*a* and paper feeding roller 37*b* feed documents M on document mounting table 35*a* one by one, by a function of the clutch. A paper feeding motor drives conveying roller 37*c*, detection roller 38, upstream side conveying roller 37*d* which is located just before the reading location. A reading motor (which is not shown in the figures) drives downstream side roller 37*e* which is located just after the reading location, conveying roller 37*f* which is located a further downstream side, and so on. A paper ejection motor (which is not shown in the figures) drives paper ejection roller 37*g*.

The paper feeding conveying motors are stepping motors, for example. Control unit 11 can control the rotation of conveying rollers 37, as needed.

Scanner unit 31 pulls document M stacked on document mounting table 35*a* into the direction of arrow S in FIG. 3. Document M is conveyed, to the reading location where contact glass 32 is placed. When light is emitted from light source 33*a* onto the document on contact glass 32, image sensor 33*b* reads images on the surface of the document, via mirrors 34*a* to 34*c*, as image data. The image reading of the document by image sensor 33*b* is being performed, while the document is being conveyed. Document M is discharged onto document receiving tray 35*b* by paper ejection roller 37*g*, after the completion of reading the document M.

Figure 4:
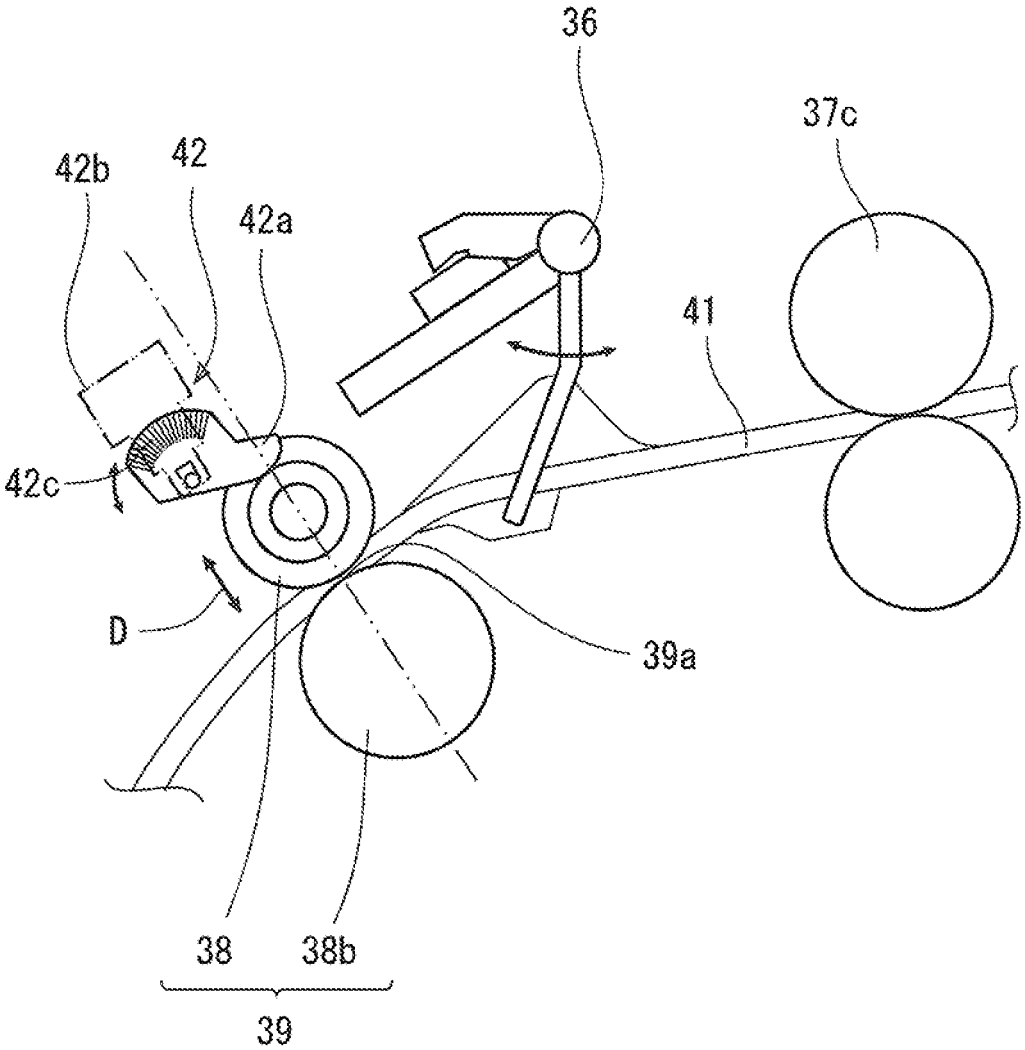
FIG. 4 is for explanation pertaining to a partial structure of a portion of a detection roller in the sheet conveying apparatus.

FIG. 4 is for explanation pertaining to a partial structure of a portion of detection roller 38 in the sheet conveying apparatus 40.

As shown in FIG. 4, reference roller 38*b* is placed, facing detection roller 38 interposing conveying path 41. Detection roller 38 is movable in the direction of arrow D. More specifically, detection roller 38 can move in the direction in which detection roller 38 moves toward or away from reference roller 38*b*. Detection roller 38 is energized, so that detection roller 38 makes contact with reference roller 38*b*. A pair of detection rollers (an example of a roller pair) 39 is configured with detection roller 38 and reference roller 38*b*. A sheet, for example document M, is conveyed, so that the sheet passes through nip portion 39*a* of the pair of detection rollers 39.

Timing sensor 36 is placed at an upstream side of a pair of detection rollers 39 in the conveying direction of a sheet. Timing sensor 36 is placed on conveying path 41 between conveying roller 37*c* and the pair of detection rollers 39. Timing sensor 36 detects an edge portion of a sheet being conveyed, for example document M. The sheet is conveyed at the proper timing, based on the detection result of timing sensor 36, and document M is read.

According to the embodiment, timing sensor 36 which detects displacement of a lever making contact with a sheet being conveyed, is used. When the leading end (an example of an edge portion) of the sheet makes contact with the lever, and the lever is displaced, timing sensor 36 detects the displacement. When the posterior end (an example of an edge portion) of the sheet passed timing sensor 36, and the lever is put back into the original location, timing sensor 36 detects the displacement.

As substitute for the above mentioned timing sensor 36, a sensor for detecting an edge portion of a sheet by using ultrasonic waves, or a sensor for detecting an edge portion of a sheet optically may be employed, for example.

Sheet conveying apparatus 40 has detection sensor 42. Detection sensor 42 is configured to output signals corresponding to displacement of detection roller 38. More specifically, according to the embodiment, an optical encoder with an actuator is used as detection sensor 42. Detection sensor 42 has lever 42*a*, and base 42*b* which supports lever 42*a* making lever 42*a* rotatable. Prism disk 42*c* which consists of transparent resin is provided with lever 42*a*. By reading prism disk 42*c* optically at the side of base 42*b*, pulse signals are output from detection sensor 42, in response to displacement of lever 42*a*.

Detection sensor 42 is attached, so that lever 42*a* is slightly pushed in from the natural state by making contact with a bearing of detection roller 38 in a state in which there is not a sheet at nip portion 39*a* (a state in which a pair of detection rollers 39 does not pinch a sheet). More specifically, when detection roller 38 is displaced, lever 42*a* is less likely to jounce, and lever 42*a* is kept making contact with the bearing of detection roller 38 at all times.

Figure 5:
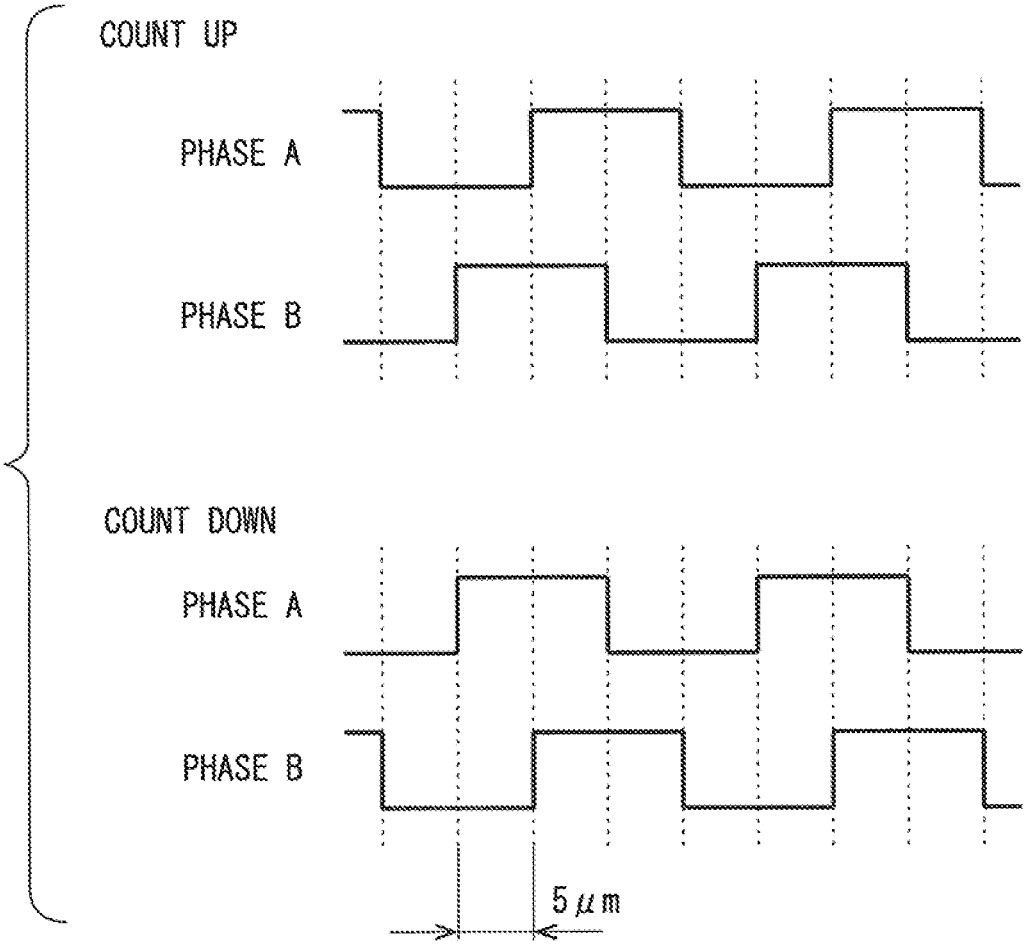
FIG. 5 schematically shows examples of signals output from the detection sensor.

FIG. 5 schematically shows an example of signals output from the detection sensor 42.

As shown in FIG. 5, detection sensor 42 outputs two signals, which are phase A pulse signal and phase B pulse signal. At the upper part of FIG. 5, an example of signals when a pushing amount of lever 42*a* from the natural state is decreasing (count up). More specifically, it is an example of signals when detection roller 38 moves to approach reference roller 38*b*. At the lower part of FIG. 5, an example of signals when a pushing amount of lever 42*a* from the natural state is increasing (count down). More specifically, it is an example of signals when detection roller 38 moves away from reference roller 38*b*.

Control unit 11 counts pulse signals of phase A and phase B which were output. Herewith, the information of the amount of displacement and the displacement direction of detection roller 38 is acquired.

In the embodiment, detection sensor 42 which has the following specifications is used, for example. The detection range is 30-600 micrometers. The resolution is 5 micrometers per count (one pulse is output for each 5 micrometers displacement). The response frequency is 60 kilohertz.

Figure 6:
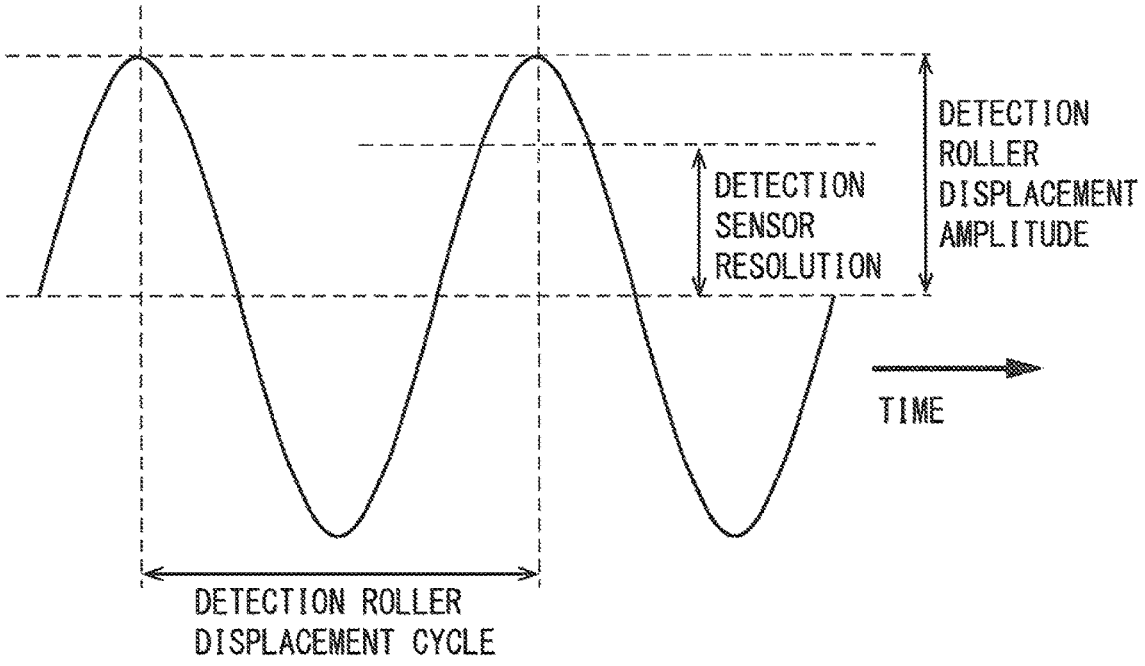
FIG. 6 is for explanation pertaining to the resolution of the detection sensor.

FIG. 6 is for explanation pertaining to the resolution of the detection sensor 42.

As shown in FIG. 6, detection roller 38 is periodically displaced with the rotation, because of the eccentricity or the like. Detection sensor 42 has a resolution in which detection sensor 42 can output a pulse signal when detection sensor 42 is displaced less than the amplitude of fluctuation in a cycle of the displacement amount of detection roller 38. Hence, even though when there is not a sheet in nip portion 39*a*, detection sensor 42 outputs signals in response to the periodical displacement of detection roller 38.

According to the embodiment, image forming apparatus 1 can detect the thickness of a sheet by using sheet conveying apparatus 40 (thickness detection behavior). The thickness detection behavior is performed, when a behavior mode of image forming apparatus 1 is the thickness detection mode. For example, when an operation is performed from a user via operation unit 13, control unit 11 sets the thickness detection mode as a behavior mode of image forming apparatus 1. When a user performs an operation to start detecting in a state in which the user placed sheet P to be detected onto document mounting table 35*a*, thickness detection behavior is executed, based on control of control unit 11.

The thickness detection behavior is performed by the pair of detection rollers 39, detection sensor 42, timing sensor 36, and so on.

Figure 7:
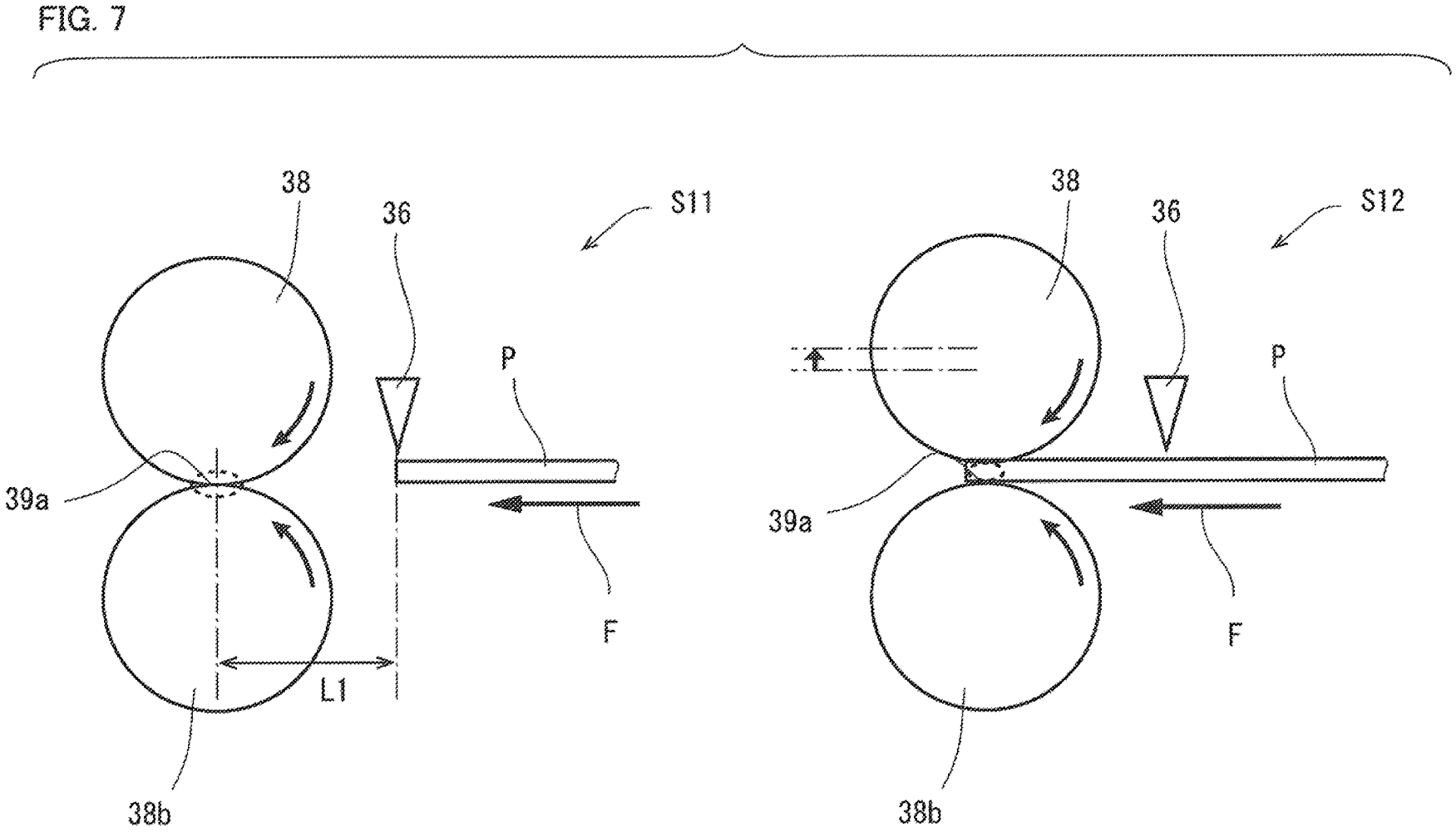
FIG. 7 is for explanation pertaining to thickness detection behavior.

FIG. 7 is for explanation pertaining to thickness detection behavior.

In FIG. 7, for explanation of the thickness detection behavior, detection roller 38 and so on are schematically illustrated. According to the embodiment, the timing when an edge portion of sheet P being conveyed passes through nip portion 39*a* is detected. In response to the detected timing, the thickness of sheet P is detected based on the signal output from detection sensor 42.

At step S11, it is assumed that sheet P is being conveyed toward nip portion 39*a*, in conveying direction F. At this situation, when the anterior end of sheet P arrives at timing sensor 36, timing sensor 36 detects the timing. Then, control unit 11 detects the timing (hereinafter, it may be referred to as passing timing) when the anterior end of sheet P passes through nip portion 39*a* (the anterior end of sheet P arrives at nip portion 39*a*), based on the timing detected by timing sensor 36, a conveying velocity of sheet P being conveyed, and length L1 of conveying path 41 from timing sensor 36 to nip portion 39*a*. The passing timing is detected before sheet P actually arrives at the pair of detection rollers 39.

When control unit 11 detects the passing timing, control unit 11 detects displacement of detection roller 38 in a predetermined period, with reference to timing immediately before the passing timing. Here, the predetermined period is from the time the detection is started to the time immediately after the anterior end of sheet P is assumed to pass nip portion 39*a*. The predetermined period is set beforehand. Control unit 11 may appropriately set the predetermined period, by using the conveying velocity of sheet P, predetermined parameters, and so on.

At step S12, when sheet P arrives at nip portion 39*a*, sheet P is pinched between detection roller 38 and reference roller 38*b*. At this time, the location of reference roller 38*b* is unchanged and detection roller 38 is displaced to move away from reference roller 38*b* through a distance of the thickness of sheet P. The displacement of detection roller 38, during a period between the time immediately before the passing timing and the time when the anterior end of sheet P was assumed to pass nip portion 39*a* is detected, to detect the thickness of sheet P.

Figure 8:
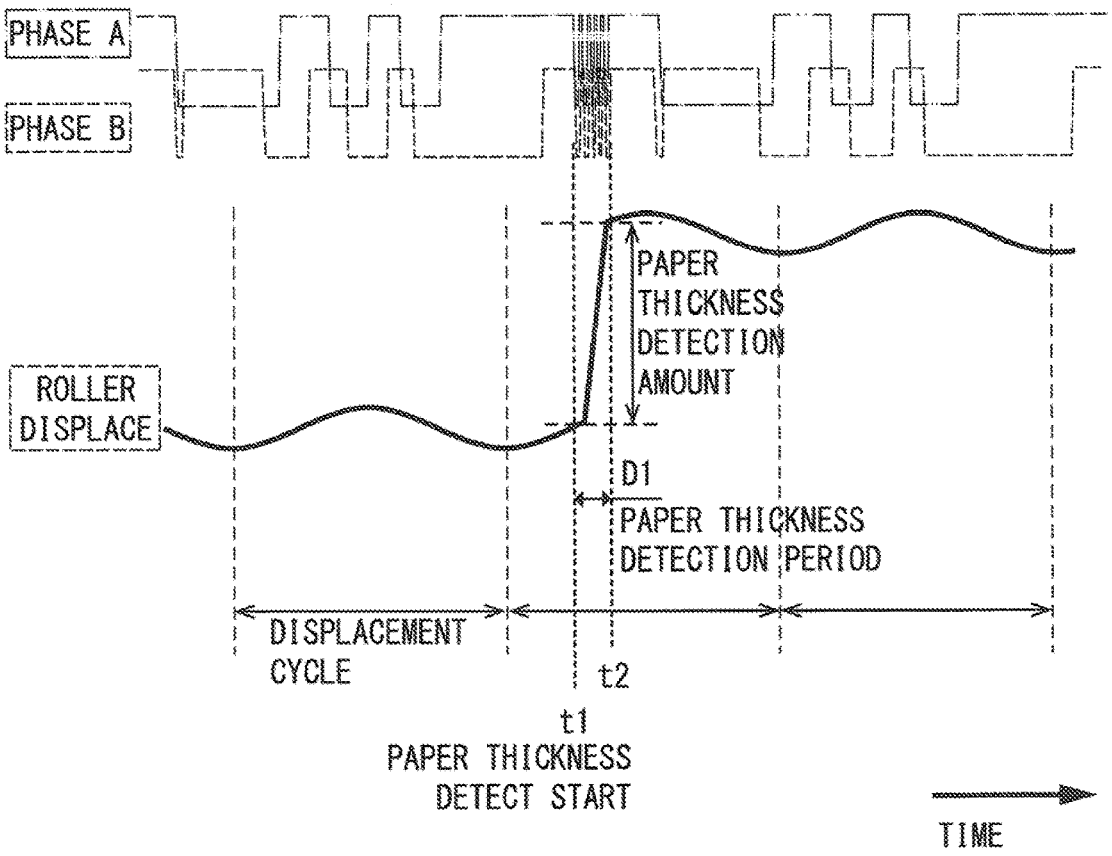
FIG. 8 is for explanation pertaining to an example of detection of the thickness of the sheet.

FIG. 8 is for explanation pertaining to an example of detection of the thickness of the sheet P.

The upper part of FIG. 8 shows the transition of the output signals of detection sensor 42. The lower part of FIG. 8 shows the transition of the displacement of detection roller 38.

When sheet P does not arrive at nip portion 39, detection roller 38 is periodically displaced. After control unit 11 detects passing timing, with sheet P being conveyed, control unit 11 begins to detect displacement of detection roller 38 at clock time t1 that is immediately before the passing timing (paper thickness detection start). Here, clock time t1 should be a time earlier than the detected passing timing by a predetermined time. More specifically, control unit 11 sets detection starting timing (clock time t1) of the displacement of detection roller 38, based on the timing detected by timing sensor 36 or the like.

For example, clock time t1 should be set, in consideration of possibility of deviations of timing for detecting the leading end of sheet P by timing sensor 36 (for example, there is the potential for deviations caused by skew of sheet P), and possibility of deviations of the conveying velocity of sheet P. More specifically, clock time t1 is set, so that the detection of the displacement of detection roller 38 is certainly started before the sheet actually arrives at nip portion 39*a*.

When clock time t1 has come, the displacement of detection roller 38 is detected from clock time t1 to clock time t2 that is after predetermined period D1. In other words, the displacement is detected from clock time t1 to clock time t2, which are set by control unit 11 beforehand. Under normal conditions, the leading end of sheet P passes through nip portion 39 during this period. Period D1 in which the displacement is detected is set to a period quite shorter than the cycle of the periodical displacement of detection roller 38. Hence, even though detection roller 38 is displaced periodically, the amount of displacement detected during the detection period is near to the thickness of sheet P. Control unit 11 calculates the amount of displacement of detection roller 38 detected during this period, as thickness information of sheet P.

Figure 9:
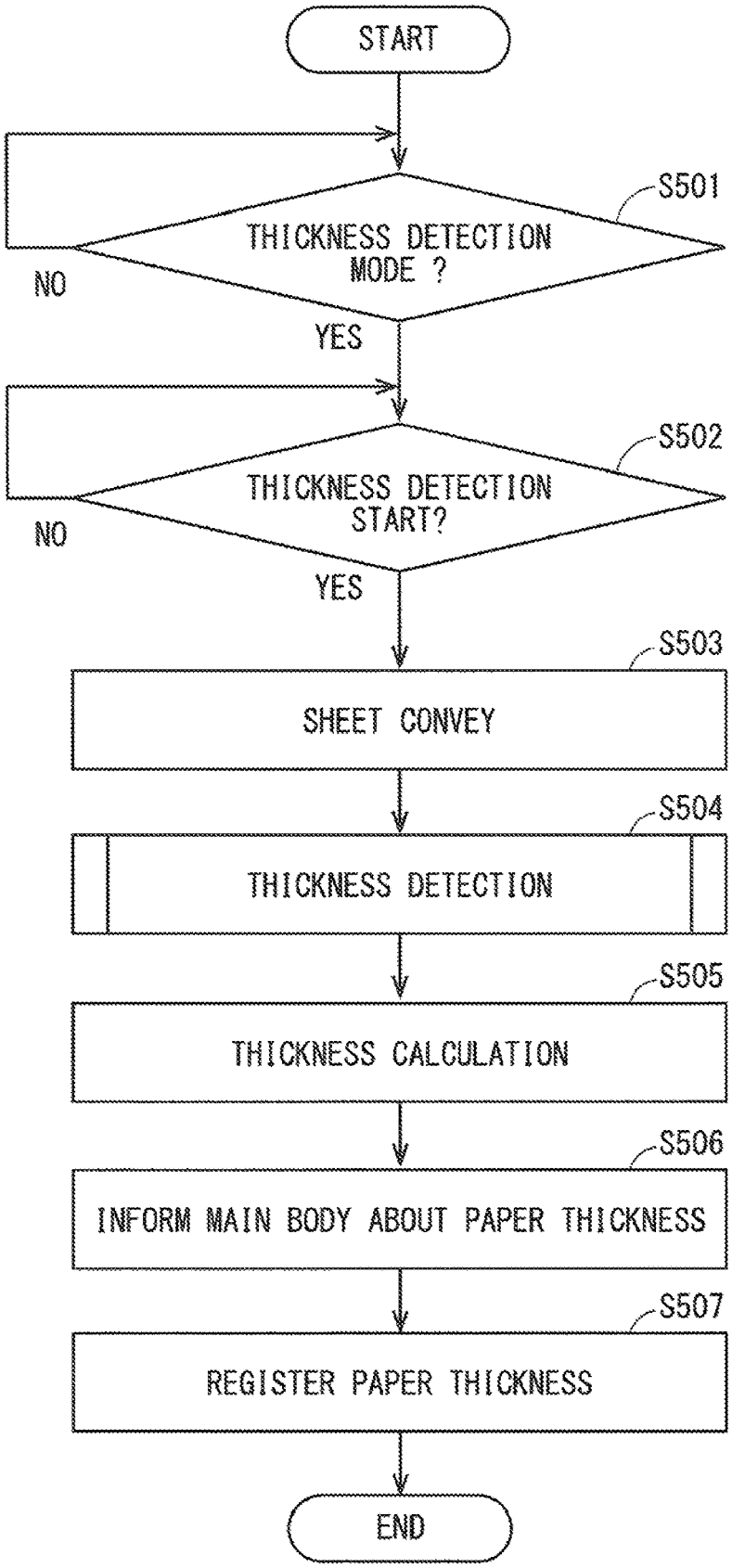
FIG. 9 shows a flowchart of behavior of an image forming apparatus, as for detection behavior of the thickness of the sheet.

FIG. 9 shows a flowchart of behavior of image forming apparatus 1, as for detection behavior of the thickness of the sheet.

The process shown in FIG. 9 is performed, based on the control of control unit 11.

As shown in FIG. 9, at step S501, whether the behavior mode is a thickness detection mode or not is confirmed. When the behavior mode is a thickness detection mode, the process of step S502 is performed.

At step S502, whether the thickness detection can be started or not is confirmed. When the thickness detection is to be started, the process of step S503 is performed. For example, when a predetermined operation is performed by a user, the thickness detection is started.

At step S503, sheet P is conveyed.

At step S504, the thickness detection process is performed. The detailed thickness detection process will be explained later.

At step S505, the thickness of sheet P is calculated, based on the result of the thickness detection process. Herewith, paper thickness information of sheet P is acquired.

According to the embodiment, the acquired paper thickness information is registered automatically in image forming apparatus 1. More specifically, at step S506, control unit 11 informs the paper thickness information to main body 10 of image forming apparatus 1. Control unit 11 stores the paper thickness information in storage unit 12, as the control of the side of main body 10.

At step S507, control unit 11 registers the paper thickness information so as to be associated with various sorts of information, so that the paper thickness information can be used on the control of main body 10. For example, the paper thickness information and the sheet name or the like specified by a user or automatically generated are registered as sheet setting information 12*b*, so as to be associated with each other.

The detected and acquired paper thickness information is registered as sheet setting information 12*b*. Hence, when image forming apparatus 1 performs image forming on sheet P to be detected, the sheet setting information 12*b* can be utilized. In this instance, displaying on display unit 14 or the like, control parameter configurations for fixing and transferring or the like related to image forming can be performed, based on sheet setting information 12*b*.

Figure 10:
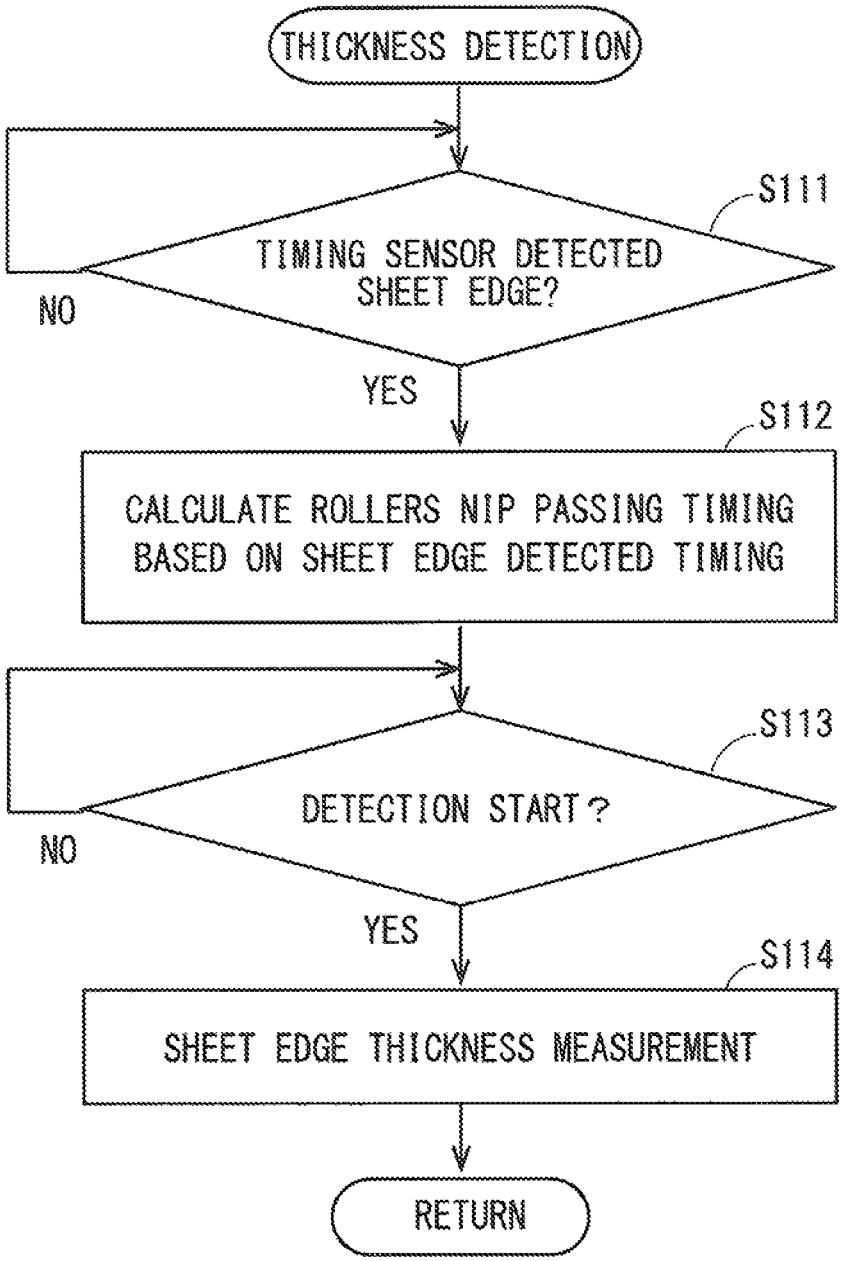
FIG. 10 shows a flowchart of a thickness detection process.

FIG. 10 shows a flowchart of a thickness detection process.

As shown in FIG. 10, in the thickness detection process, whether timing sensor 36 detected an edge portion (a sheet edge) of sheet P or not is continued at step S111. When detected, the process of step S112 is executed.

At step S112, the timing when the sheet edge pass through nip portion 39*a* is calculated, based on the timing when the sheet edge was detected.

At step S113, control unit 11 waits till the timing to start detecting, that is immediately before the passing timing, based on the calculated passing timing. At the timing, the process of step S114 is executed.

At step S114, the displacement of detection roller 38 from when the detection was started to when the predetermined time elapsed is detected. Herewith, the thickness of the sheet edge is measured.

After the completion of the measurement, the processing is returned to FIG. 9, and the thickness of sheet P is calculated based on the measurement result.

The thickness detection process will be explained more concretely, as follows.

Figure 11:
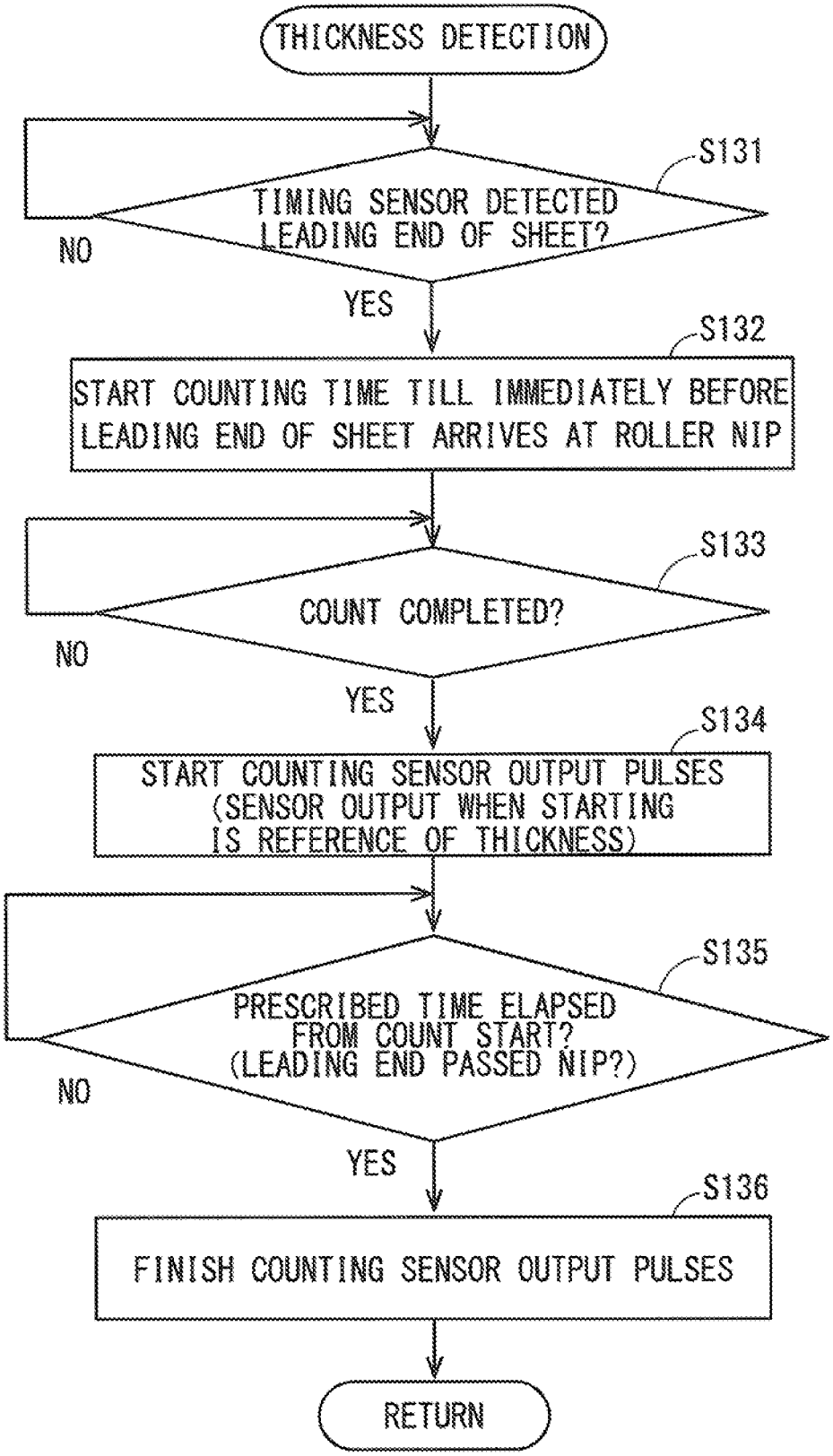
FIG. 11 concretely shows a flowchart of a thickness detection process.

FIG. 11 concretely shows a flowchart of a thickness detection process.

In FIG. 11, step S131 corresponds to step S111 in FIG. 10, steps S132 and S133 correspond to steps S112 and 113 in FIG. 10, and steps S134, S135, and S136 correspond to step S114 in FIG. 10.

As shown in FIG. 11, at step S131, the leading end of sheet P is detected by timing sensor 36.

At step S132, in response to the detection timing of the leading end of sheet P, the passing timing when the leading end of sheet P arrives at nip portion 39*a* is calculated. Then, the period from now to immediately before the passing timing is counted.

At step S133, whether the counting was completed or not, more specifically, whether it is the time immediately before the passing timing or not is determined. When the counting was completed, the thickness measurement at step S134 and the following steps is performed.

At step S134, control unit 11 begins to count signal pulses output from detection sensor 42. More specifically, the location of detection roller 38 when starting of the counting for the thickness measurement is the reference for detecting the thickness of sheet P.

At step S135, control unit 11 confirms whether the predetermined period from starting of the pulse counting has elapsed or not. Until the predetermined time elapses, the counting is kept. When the predetermined time elapsed, the process of step S136 is performed. The predetermined time is from starting of the counting to an estimated time when the leading end of the sheet passed through nip portion 39*a*. Therefore, at this time, control unit 11 confirms whether the leading end of sheet P passed through nip portion 39*a* or not.

At step S136, control unit 11 stops the pulse counting. Herewith, the output pulses of detection sensor 42 in response to the displacement of detection roller 38 was counted, from the time immediately before the leading end of sheet P passes through nip portion 39*a* to immediately after the leading end of sheet P passes through nip portion 39*a*. The number of counted pulses corresponds to the difference between the location of detection roller 38 as the reference when starting of the detection, and the location of detection roller 38 when finishing of the detection after the predetermined time.

After the completion of the process of step S136, the processing is returned to FIG. 9. Herewith, the thickness of sheet P is calculated as the difference between the location of detection roller 38 when starting of the detection as the reference and the location of detection roller 38 when finishing of the detection after the predetermined time.

According to the embodiment, the thickness of the leading end of sheet P is detected as the thickness of sheet P. The thickness of the posterior end of sheet P may be detected as the thickness of sheet P.

Figure 12:
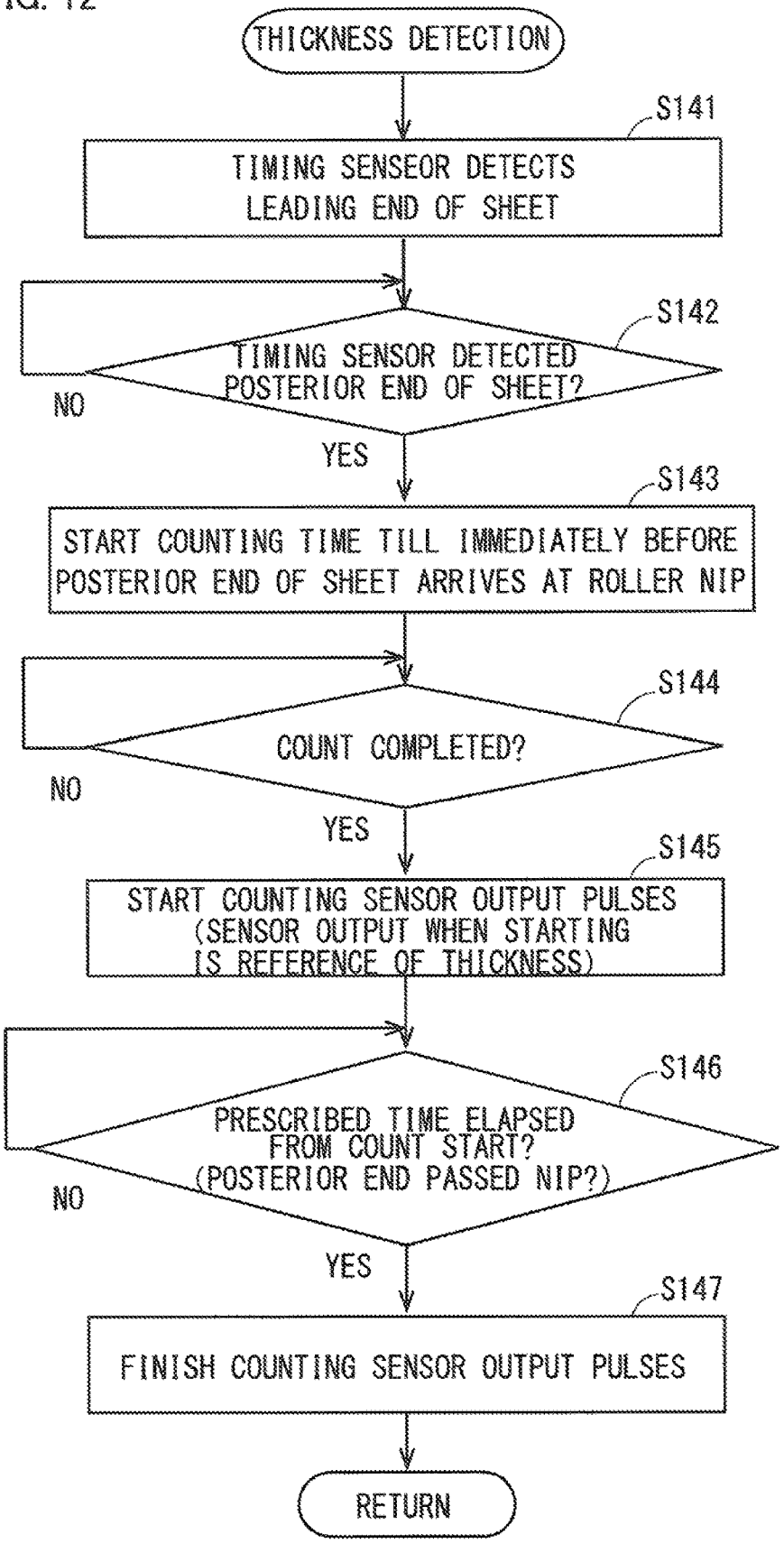
FIG. 12 concretely shows a flowchart of a thickness detection process, when the thickness of the posterior end of the sheet is detected.

FIG. 12 concretely shows a flowchart of a thickness detection process, when the thickness of the posterior end of the sheet P is detected.

In FIG. 12, except for one thing of whether focusing attention on a leading end of a sheet or focusing attention on a posterior end of a sheet, steps S142 to S147 are similar to steps S131 to S136 in FIG. 11, respectively. More specifically, step S142 corresponds to step S111 of FIG. 10, steps S143 and S144 correspond to steps S112 and 113 in FIG. 10, and steps S145, S146 and S147 correspond to step S114 in FIG. 10.

When the leading end of sheet P is detected by timing sensor 36 at step S141, the apparatus waits till the detection timing of the posterior end of sheet P, at step S142.

When the posterior end of sheet P was detected, the passing timing when the posterior end of sheet P arrives at nip portion 39*a* is calculated, in response to the detecting timing of the posterior end of sheet P, at step S143. Then, the period from now to immediately before the passing timing is counted.

At step S144, whether the counting was completed or not is determined. When the counting was completed, the thickness measurement at step S145 and the following steps is performed.

At step S145, control unit 11 begins to count signal pulses output from detection sensor 42. At this time, nip portion 39*a* is pinching sheet P. The location of detection roller 38 at this time is the reference for detecting the thickness of sheet P.

At step S146, control unit 11 conforms whether the predetermined period from starting of the pulse counting has elapsed or not. Until the predetermined time elapses, the counting is kept. When the predetermined time elapsed, the process of step S147 is performed. The predetermined time is from starting of the counting to an estimated time when the posterior end of the sheet passed through nip portion 39*a*.

At step S147, control unit 11 stops the pulse counting. Herewith, the output pulses of detection sensor 42 in response to the displacement of detection roller 38 was counted, from the time immediately before the posterior end of sheet P passes through nip portion 39*a* to immediately after the posterior end of sheet P passes through nip portion 39*a*. After the completion of the process of step S147, the processing is returned to FIG. 9. Herewith, the thickness of sheet P is calculated In this manner, when the thickness of the posterior end of sheet P is to be detected, detection roller 38 is displaced to the direction for approaching reference roller 38*b*, around the time when the posterior end of sheet P passes through nip portion 39*a*. Hence, the thickness of sheet P can be detected.

As explained above, according to the embodiment, an amount of displacement of detection roller 38, from the time immediately before the edge portion of sheet P passes through nip portion 39*a* to the time immediately after the edge portion of sheet P passes through nip portion 39*a*, can be detected as thickness of sheet P. Therefore, even though the amount of displacement of detection roller 38 includes the periodical fluctuation, the fluctuation has minimal impact on the detection result of the thickness of sheet P. Therefore, the thickness of sheet P can be detected with high precision.

For the thickness detection, there is no necessity to use data related to the periodical fluctuation of the amount of displacement of detection roller 38. Then, there is no necessity to acquire or store such data separately from thickness detection behavior. In addition, there is no necessity to perform calculation by using the data with complex algorithm, separately from thickness detection behavior. Therefore, the structure of image forming apparatus 1 can be simplified, and the manufacturing cost of image forming apparatus 1 can be reduced.

According to the first embodiment, an optical encoder with an actuator to output pulse signals is used, as detection sensor 42. Then, it has an effect of the followings, compared to using a variety of sensors. More specifically, since detection sensor 42 outputs pulse signals, the output signals are less affected by noise, individual variability of the circuit, fluctuation of electric power supply voltage, or the like, and the displacement of detection roller 38 can securely be detected. As compared with outputting analog micro signals which demand comparatively complex signal process and calculation process, the detection result can be acquired only by detecting count up/countdown. Since detection sensor 42 is small, detection sensor 42 can be installed close to detection roller 38, as compared with using a triangulation type sensor that measures distance optically or the like. Hence, image forming apparatus 1 can be downsized. In addition, the displacement of detection roller 38 can be detected, regardless of the surface state of detection roller 38.

The Second Embodiment

Since basic structure of the image forming apparatus according to the second embodiment is the same as shown in the first embodiment, the explanation will not be repeated. According to the second embodiment, a skew correction of sheet P is performed, before the thickness detection behavior. This point is different from the first embodiment.

Figure 13:
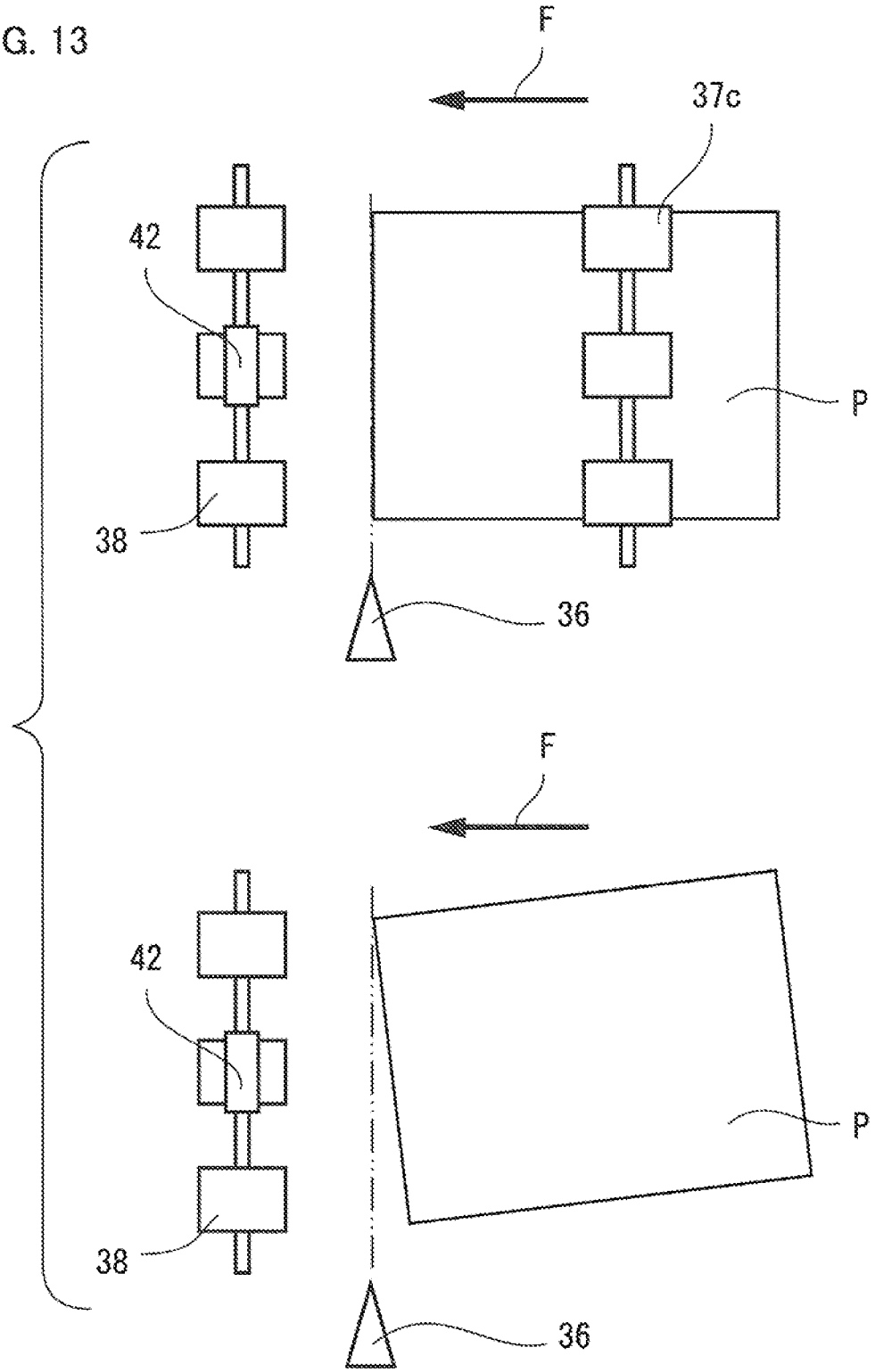
FIG. 13 is for explanation pertaining to thickness detection behavior of an image forming apparatus, according to the second embodiment of this invention.

FIG. 13 is for explanation pertaining to thickness detection behavior of an image forming apparatus 1, according to the second embodiment of this invention.

In FIG. 13, a plan view around detection roller 38 is schematically illustrated. The upper part of the figure shows an example to perform a skew correction before the thickness detection behavior. The lower part of the figure shows an example not to perform the skew correction.

When the skew correction is not performed, and sheet P is conveyed being skewed with respect to conveying direction F, for example, there is the potential for problems for the thickness detection behavior. More specifically, when sheet P is skewed, edge portions of the anterior end and the posterior end of sheet P are inclined with respect to a direction perpendicular to conveying direction F of sheet P. Therefore, when timing sensor 36 detects a portion of the edge, there is the potential for difference between the distance from the portion of the edge to nip portion 39*a*, and distance from another portion of the edge to nip portion 39*a*. In this instance, when the passing timing calculated based on the detection result of timing sensor 36 actually comes, there is the potential for cases in which another edge portion was already pinched by nip portion 39*a*, or another edge portion is far from nip portion 39*a*. In such the cases, the passing timing differs from the timing when the sheet actually passes through nip portion 39*a*. Therefore, there is the potential for lowering degree of thickness detection accuracy of the edge portion of sheet P.

On the other hand, as shown in the upper part of FIG. 13, it is assumed that a skew correction is performed by conveying roller 37*c* at an upstream side of nip portion 39*a*, for example. Even though sheet P being conveyed is skewed before arriving conveying roller 37*c*, the skew is corrected by conveying roller 37*c* when being conveyed. The edge portion is detected by timing sensor 36 in a straight direction. Therefore, according to the second embodiment, the problem related to variation of detection timing as mentioned above does not occur, and the thickness of an edge portion of sheet P can be detected suitably.

According to the example shown in FIG. 13, conveying roller 37*c* performs the skew correction. The invention is not limited to the embodiment. The skew correction of sheet P may be performed by other kinds of rollers. The register roller which performs the skew correction of sheet P may behave as detection roller 38.

The Third Embodiment

Since basic structure of the image forming apparatus according to the third embodiment is the same as shown in the first embodiment, the explanation will not be repeated. According to the third embodiment, one detection roller which plays both two roles of a register roller and a roller for sheet thickness detection behavior is used. This point is different from the first embodiment.

Figure 14:
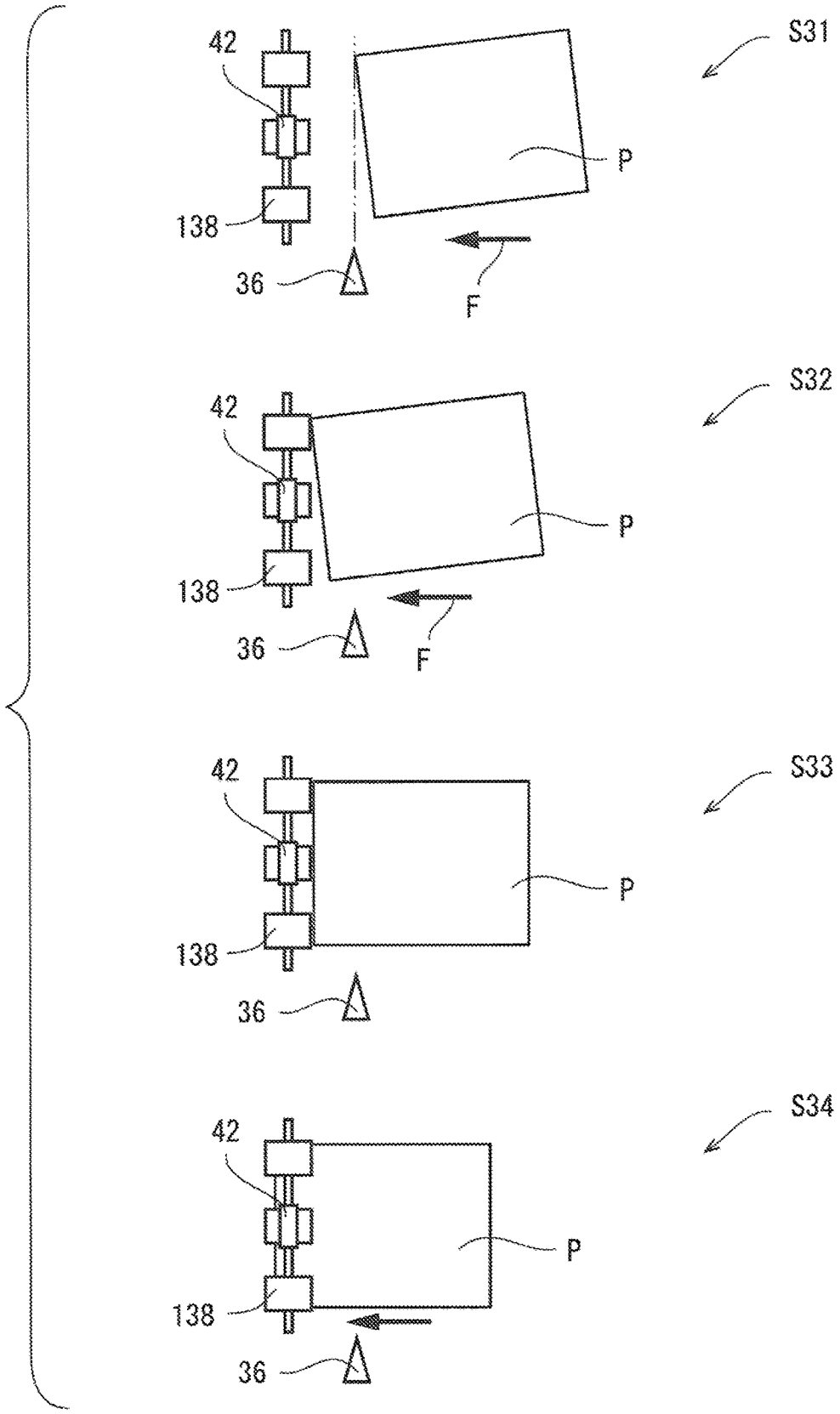
FIG. 14 is for explanation pertaining to thickness detection behavior of an image forming apparatus, according to the third embodiment of this invention.

FIG. 14 is for explanation pertaining to thickness detection behavior of image forming apparatus 1, according to the third embodiment of this invention.

According to the third embodiment, as substitute for detection roller 38, detection roller 138 is provided. This is different from the above mentioned the first embodiment. More specifically, detection roller 138 performs a skew correction of sheet P, and detection roller 138 is a register roller which adjusts paper re-feeding timing. A skew correction for sheet P is performed by detection roller 138 and reference roller 38*b* (which is not shown in FIG. 14). Then, detection roller 138 performs paper re-feeding, so that sheet P passes through nip portion 39*a*.

More specifically, it is assumed that skewed sheet P is being conveyed at step S31. At this time, timing sensor 36 detects the anterior end of sheet P. Paper re-feeding timing is set, in response to detection timing of timing sensor 36.

At step S32, the leading end of sheet P arrives at detection roller 138.

At step S33, the detection roller 138 prevents sheet P from entering nip portion 39*a*, so that the skew correction of sheet P is performed.

At step S34, paper re-feeding is performed by detection roller 138. Herewith, sheet P enters nip portion 39*a* the leading end first, and passes through nip portion 39*a*.

When thickness detection behavior is performed, the displacement of detection roller 138 is detected during a predetermined period which starts immediately before the paper re-feeding timing, wherein the paper re-feeding timing is determined by the detection result of timing sensor 36, for example. Herewith, as same as mentioned above, the thickness of the leading end of sheet P which passes through nip portion 39*a* is detected, when starting the paper re-feeding.

Figure 15:
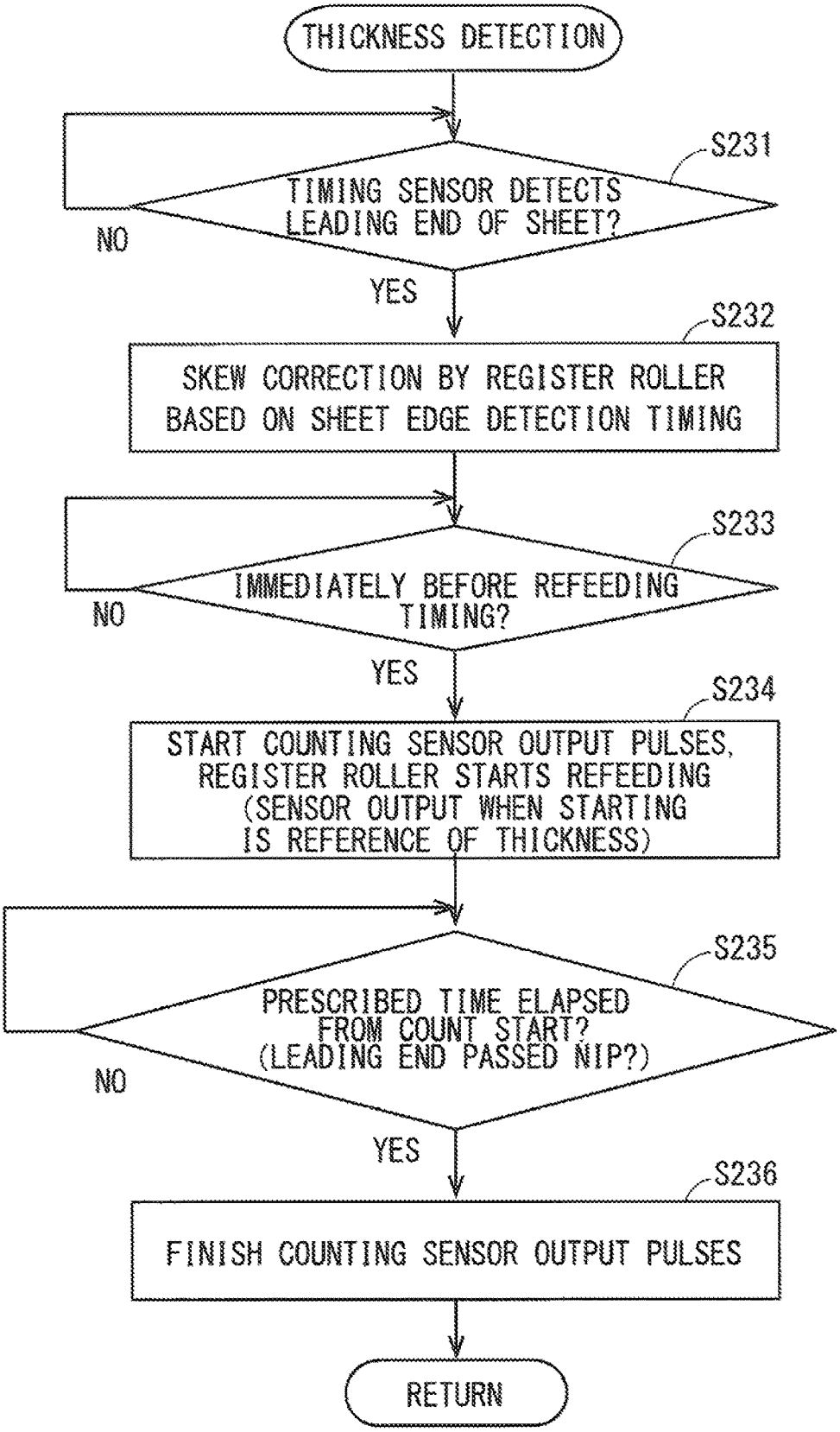
FIG. 15 shows a flowchart for explanation of thickness detection behavior, according to the third embodiment.

FIG. 15 shows a flowchart for explanation of thickness detection behavior, according to the third embodiment.

FIG. 15 is a flowchart which corresponds to FIGS. 10, 11, and so on of the above mentioned first embodiment. According to the third embodiment, basic behavior before and after the thickness detection behavior, shown in FIG. 9 of the first embodiment is performed similarly. In FIG. 15, step S231 corresponds to step S111 in FIG. 10. Steps S232 and S233 correspond to steps S112 and 113 in FIG. 10. Steps S234, S235 and S236 correspond to step S114 in FIG. 10.

As shown by FIG. 15, at step S231, the leading end of sheet P is detected by timing sensor 36. The paper re-feeding timing is set, in response to detection timing of timing sensor 36.

At step S232, skew correction behavior for sheet P is performed till the paper re-feeding timing, in response to the detecting timing of the leading end of sheet P.

At step S233, whether it is immediately before paper re-feeding timing of detection roller 138 or not is determined.

At step S234, control unit 11 begins to count signal pluses output from detection sensor 42, immediately before paper re-feeding timing. More specifically, the location of detection roller 138 at the start of the counting for thickness measurement is the reference for detecting the thickness of sheet P.

At step S235, control unit 11 confirms whether the predetermined period has elapsed or not from the starting of the pulse counting. Until the predetermined time elapses, the counting is kept. When the predetermined time elapsed, the process of step S236 is performed.

At step S236, control unit 11 stops the pulse counting. Herewith, the output pulses of detection sensor 42 in response to the displacement of detection roller 138 was counted, from the time immediately before the anterior end of sheet P passes through nip portion 39*a* to immediately after the anterior end of sheet P passes through nip portion 39*a*. The number of counted pulses corresponds to the difference between the location of detection roller 38 as the reference immediately before the paper re-feeding timing, and the location of detection roller 38 when finishing of the detection after the predetermined time.

After the completion of the process of step S236, the processing is returned to FIG. 9. Herewith, the thickness of sheet P is calculated as the difference between the location of detection roller 38 immediately before the paper re-feeding timing as the reference and the location of detection roller 38 when finishing of the detection after the predetermined time.

According to the third embodiment, the one detection roller 138 is configured to play two roles of a register roller and a roller for sheet thickness detection behavior. Hence, the mechanical structure of image forming apparatus 1 can be simplified. Further, after performing a skew correction, the thickness of sheet P can be detected with high precision.

In such a situation in which detection roller 138 plays two roles of a register roller and a roller for thickness detection behavior, control unit 11 may control the thickness detection behavior as follows. More specifically, when a skew correction for sheet P was performed and detection sensor 42 detected detection roller 138 vibrating, control unit 11 may wait and prevent sheet P passing through nip portion 39*a*, till the vibration of detection roller 138 is damped.

Figure 16:
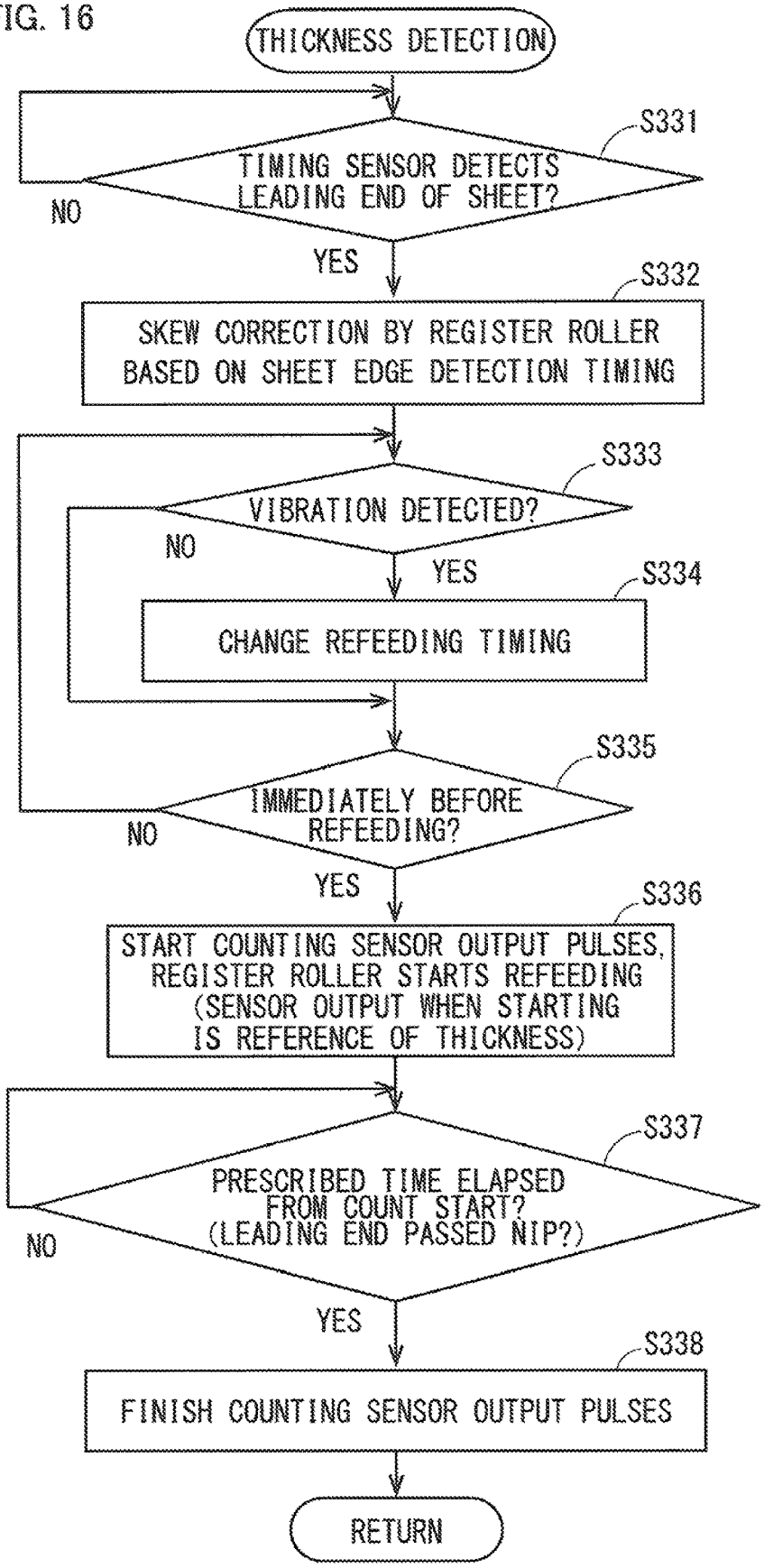
FIG. 16 shows a flowchart for explanation of a modification, according to the third embodiment.

FIG. 16 shows a flowchart for explanation of a modification, according to the third embodiment.

In FIG. 16, steps S331 and S332 are similar to steps S231 and S232 in FIG. 15. Steps S335-S338 are similar to steps S233-S236 in FIG. 15.

According to this modification, when a skew correction was performed, control unit 11 determines whether detection roller 138 is vibrating or not at step S333. When detection roller 138 is vibrating, the process of step S334 is performed. When detection roller 138 is not vibrating, the process of step S335 is performed.

At step S334, control unit 11 changes the paper re-feeding timing. More specifically, control unit 11 changes the paper re-feeding timing, so that the paper re-feeding timing is set to be later. Herewith, before the changed paper re-feeding timing, the waiting state in which the paper re-feeding is not performed is maintained.

At step S335, whether it is immediately before the paper re-feeding timing or not is detected. When it is not immediately before the paper re-feeding timing, the vibration detection (step S333) and the change of the paper re-feeding timing corresponding to the vibration detection (step S334) are performed again.

When the paper re-feeding timing comes, the process of step S336 and the following steps is performed.

Figure 17:
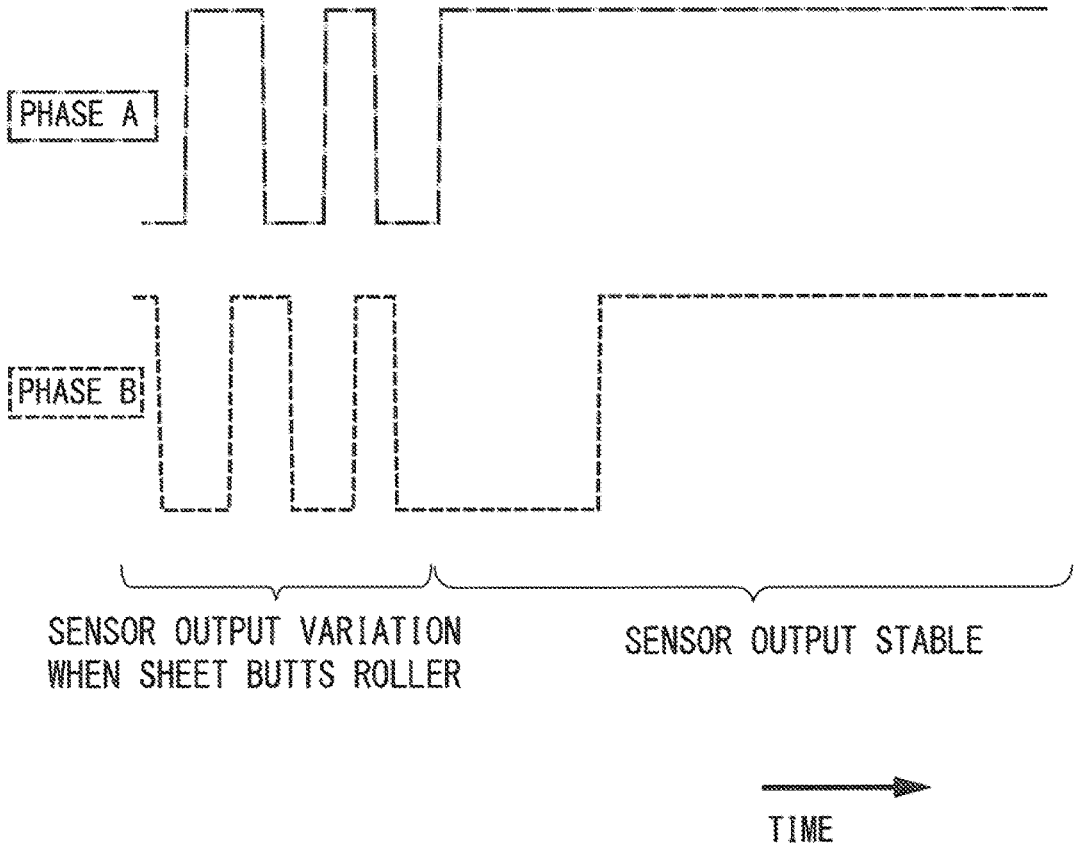
FIG. 17 shows examples of signals output from the detection sensor, when a skew correction is performed.
Figure 18:
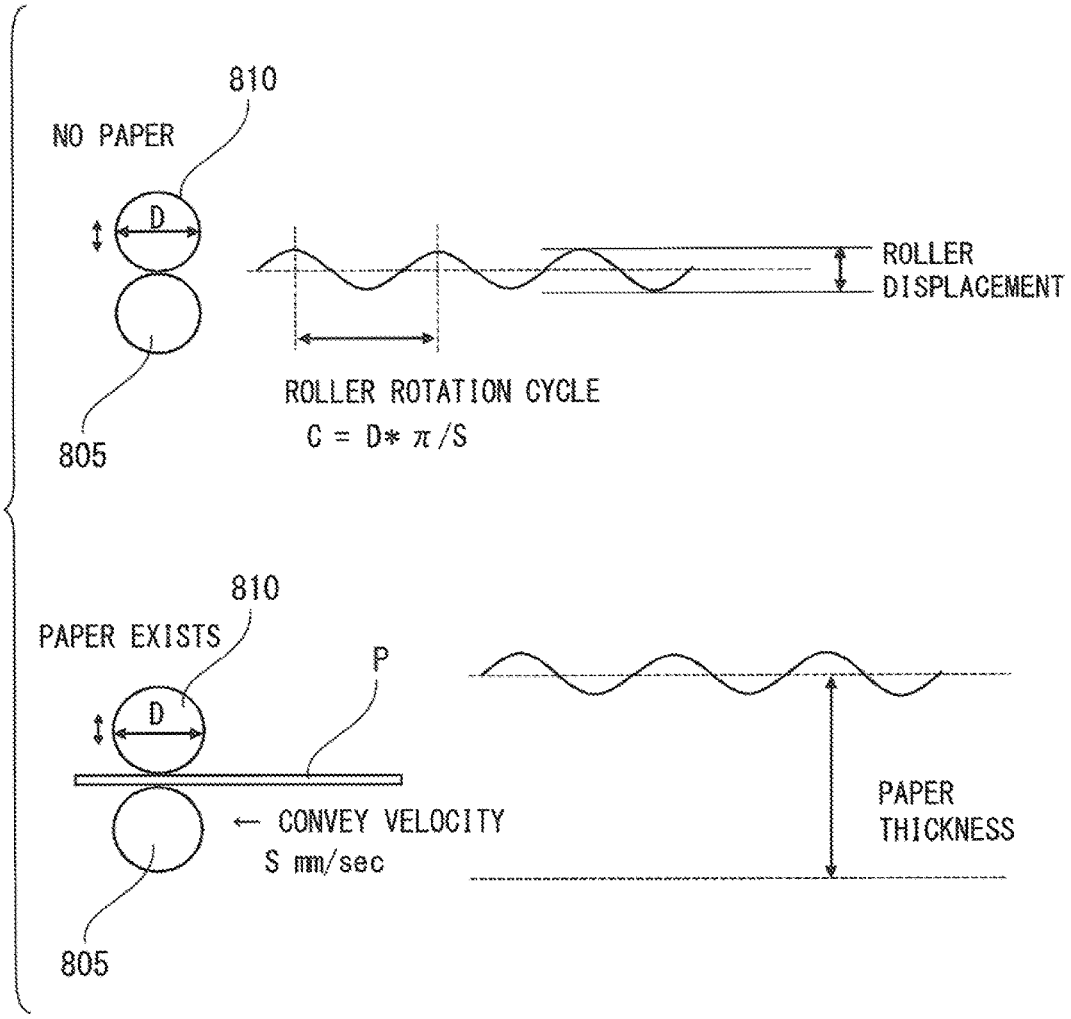
FIG. 18 is for explanation pertaining to a conventional detection method.

FIG. 17 shows an example of signal output from the detection sensor 42, when a skew correction is performed.

When the thickness detection behavior is performed by using detection roller 138 which is used as a register roller, and sheet P butts detection roller 138 for the skew correction, the detection roller 138 may vibrate. Then, as shown in FIG. 17, the output of detection sensor 42 fluctuates until the vibration of detection roller 138 is damped. According to the modification, the state is set as a waiting state, till the signal of detection sensor 42 stabilizes. After the output of detection sensor 42 stabilized, the paper re-feeding begins. Therefore, the detection result of thickness of sheet P is prevented from being affected by the vibration of detection roller 138. The thickness of sheet P can be detected, with high precision.

Whether the vibration of detection roller 138 is damped or not can be determined as follows. For example, when a signal pulse output from detection sensor 42 was previously counted and a predetermined time elapsed, it can be determined that detection sensor 42 stabilized and the vibration of detection roller 138 is damped.

[Others]

The characterizing portions in the above mentioned embodiments can be appropriately exchanged. Parts of the characterizing portions may be omitted. In such a way, a sheet conveying apparatus and an image forming apparatus with the same can be configured.

When the detection behavior of the thickness of the sheet was performed, the information may not be registered in the main body of an image forming apparatus, as sheet setting information. For example, the acquired paper thickness information may be informed to users by displaying it on a display unit. When the paper thickness information was acquired, the paper thickness information can be used for the control related to the image forming, which is performed in the next image forming job.

The detection sensor is not limited to the above mentioned an optical encoder with an actuator. For example, an angle sensor in which an angle of a detection probe is changed in accordance with the displacement of the detection roller, can be used. A triangulation type optical sensor for detecting the displacement by receiving reflected light from the object, may be used.

The locations of the detection roller and the timing sensor on the sheet conveying path are not limited to the above mentioned. The timing sensor can be installed at an upstream side of the detection roller and the reference roller, in a conveying direction.

An image forming apparatus can be a copying machine, a printer, a facsimile device, multifunction machine (MFP) of these apparatuses, or the like of black-and-white/colors. The apparatus is not limited to an apparatus which forms images by electrophotographic technology. For example, the apparatus may form images by so-called ink jet method.

The hardware configuration of an image forming apparatus is not limited the above mentioned. The use of the sheet conveying apparatus which performs thickness detection behavior is not limited to a scanner unit. For example, in a sheet conveying apparatus which conveys sheets in a main body of an image forming apparatus, thickness detection behavior may be performed by using a pair of detection rollers, a timing sensor, and so on, placed on the conveying path. In this instance, a conveying path for thickness detection to make a detour to avoid a path on which sheets pass during the image forming behavior, when thickness detection behavior is performed, may be installed. To make a detour to avoid a transfer roller and a fixing roller in the image forming unit during thickness detection behavior, the lifetime of parts installed in the image forming unit can be extended.

The processes in the above mentioned embodiments can be performed by software and a hardware circuit.

A computer program which executes the processes in the above embodiments can be provided. The program may be provided recorded in recording media of CD-ROMs, flexible disks, hard disks, ROMs, RAMs, memory cards, or the like to users. The program is executed by a computer of a CPU or the like. The program may be downloaded to a device via communication lines like the internet. The processes explained in the above flowcharts and the description are executed by a CPU in line with the program.

The Effect of these Embodiments

According to the embodiments, the timing when an edge portion of a sheet being conveyed passes through a nip portion is detected. In response to the detected timing, the thickness of the sheet is detected, based on the output signals of the detection sensor. Therefore, a sheet conveying apparatus, an image forming apparatus, a control method for a sheet conveying apparatus, and a control program for a sheet conveying apparatus, which can detect the thickness of the sheet with the simple structure and high degree of accuracy, can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet conveying apparatus comprising:

a pair of rollers including a reference roller and a detection roller, wherein the detection roller can move and faces and makes contact with the reference roller, a detection sensor for outputting a signal corresponding to displacement of the detection roller, a conveying unit for conveying a sheet to a nip portion of the pair of rollers in a conveying direction, a timing sensor placed upstream of the pair of rollers in the conveying direction, a timing detection unit for detecting timing when an edge portion of the sheet which is conveyed by the conveying unit passes through the nip portion, based on timing detected by the timing sensor, and a thickness detection unit for detecting a thickness of the sheet, in response to the timing detected by the timing detection unit, based on the signal output from the detection sensor, wherein the thickness detection unit is configured to start detecting the thickness of the sheet before a first time when a leading end of the sheet enters the nip portion.

2. The sheet conveying apparatus according to claim 1, wherein the timing detection unit detects the timing when the edge portion of the sheet passes through the nip portion, based on timing detected by the timing sensor, a conveying velocity of the sheet being conveyed by the conveying unit, and a length of the sheet conveying path from the timing sensor to the nip portion.

3. The sheet conveying apparatus according to claim 1, wherein the thickness detection unit is configured to:

start detecting the thickness of the sheet, immediately before the first time when the leading end of the sheet enters the nip portion, finish detecting the thickness of the sheet, at a second time when a predetermined time elapsed from when the detection of the thickness of the sheet was started, wherein the second time is when the leading end of the sheet passed through the nip portion, and calculate a difference between a location of the detection roller at the start of the detecting as a reference and a location of the detection roller at the end of the detecting, as the thickness of the sheet, based on the output of the detection sensor.

4. The sheet conveying apparatus according to claim 1, wherein the thickness detection unit is configured to:

start detecting the thickness of the sheet, immediately before the first time when the posterior end of the sheet passes the nip portion, finish detecting the thickness of the sheet, at a second time when a predetermined time elapsed from when the detection of the thickness of the sheet was started, wherein the second time is when the posterior end of the sheet passed through the nip portion, and calculate a difference between a location of the detection roller at the start of the detecting as a reference and a location of the detection roller at the end of the detecting, as the thickness of the sheet, based on the output of the detection sensor.

5. The sheet conveying apparatus according to claim 1, wherein the detection sensor outputs a pulse signal, each time the detection roller is displaced a predetermined amount, and the thickness detection unit counts the pulse signal output from when the detection of the thickness of the sheet was started to when a predetermined time elapses, and detects the thickness of the sheet in response to the number of counts.

6. The sheet conveying apparatus according to claim 1, wherein the detection sensor has a resolution in which a signal is output in response to the displacement of the detection roller, when the displacement of the detection roller is smaller than an amplitude of fluctuation of an amount of displacement of the detection roller in a revolution of the detection roller.

7. The sheet conveying apparatus according to claim 1, further comprising:

a skew correction unit for perform a skew correction at an upstream side of the pair of rollers in the conveying direction of the sheet, wherein the sheet passes through the nip portion after the skew correction was performed by the skew correction unit.

8. The sheet conveying apparatus according to claim 7, wherein the timing detection unit detects the timing when the edge portion of the sheet passes through the nip portion after the skew correction was performed by the skew correction unit.

9. The sheet conveying apparatus according to claim 1, wherein the pair of rollers is register rollers, and the sheet passes through the nip portion after the skew correction was performed by the pair of rollers, when the leading end of the sheet arrives at the pair of rollers.

10. The sheet conveying apparatus according to claim 9, wherein the sheet is prevented from passing through the nip portion until vibration of the detection roller has been damped, the skew correction of the sheet has been performed by the pair of rollers, and the detection sensor has detected the detection roller vibrating.

11. The sheet conveying apparatus according to claim 10, wherein the thickness detection unit detects the thickness of the sheet, based on the signal output from the detection sensor, using the location of the detection roller at a timing of paper re-feeding of the sheet as a reference, when the sheet was prevented from passing the nip portion and waited, and the sheet is re-fed to pass the nip portion.

12. The sheet conveying apparatus according to claim 11, wherein the detection sensor is an optical encoder with an actuator.

13. An image forming apparatus comprising:

the sheet conveying apparatus according to claim 1, and an image forming unit to form an image on the sheet of which the thickness was detected by the sheet conveying apparatus.

14. An image forming apparatus comprising:

a document reading device to read a document as an image, and an image forming unit to form the image read by the document reading device on the sheet, wherein the document reading device has the sheet conveying apparatus according to claim 1, and reads the document conveyed by the sheet conveying apparatus as the image.

15. The image forming apparatus according to claim 13, further comprising:

a control unit to control image forming behavior using the image forming unit, by using the thickness information of the sheet detected by the sheet conveying apparatus.

16. The image forming apparatus according to claim 13, wherein the sheet conveying apparatus performs detection behavior for the thickness of the sheet, when a behavior mode of the image forming apparatus is a predetermined behavior mode.

17. A method of controlling a sheet conveying apparatus, wherein the sheet conveying apparatus comprising:

a pair of rollers including a reference roller and a detection roller, wherein the detection roller can move and faces and makes contact with the reference roller, a detection sensor for outputting a signal corresponding to displacement of the detection roller, a conveying unit for conveying a sheet to a nip portion of the pair of rollers in a conveying direction, and a timing sensor placed upstream of the pair of rollers in the conveying direction, wherein the method includes:

detecting timing when an edge portion of the sheet which is conveyed by the conveying unit passes through the nip portion, based on timing detected by the timing sensor, and detecting a thickness of the sheet, in response to the timing detected, based on the signal output from the detection sensor, including starting detecting the thickness of the sheet before a first time when a leading end of the sheet enters the nip portion.

18. The method of controlling a sheet conveying apparatus according to claim 17, wherein the method further includes:

starting detecting the thickness of the sheet, immediately before the first time when the leading end of the sheet enters the nip portion, finishing detecting the thickness of the sheet, at a second time when a predetermined time elapsed from when the detection of the thickness of the sheet was started, wherein the second time is when the leading end of the sheet passed through the nip portion, and calculating a difference between a location of the detection roller at the start of the detecting as a reference and a location of the detection roller at the end of the detecting, as the thickness of the sheet, based on the output of the detection sensor.

19. The method of controlling a sheet conveying apparatus according to claim 17, wherein the method further includes:

starting detecting the thickness of the sheet, immediately before the first time when the posterior end of the sheet passes the nip portion, finishing detecting the thickness of the sheet, at a second time when a predetermined time elapsed from when the detection of the thickness of the sheet was started, wherein the second time is when the posterior end of the sheet passed through the nip portion, and calculating a difference between a location of the detection roller at the start of the detecting as a reference and a location of the detection roller at the end of the detecting, as the thickness of the sheet, based on the output of the detection sensor.

20. A non-transitory computer-readable recording medium storing a controlling program for a sheet conveying apparatus, wherein the sheet conveying apparatus comprising:

a pair of rollers including a reference roller and a detection roller, wherein the detection roller can move and faces and makes contact with the reference roller, a detection sensor for outputting a signal corresponding to displacement of the detection roller, a conveying unit for conveying a sheet to a nip portion of the pair of rollers in a conveying direction, and a timing sensor placed upstream of the pair of rollers in the conveying direction, wherein the program causes a computer to execute the steps of:

detect timing when an edge portion of the sheet which is conveyed by the conveying unit passes through the nip portion, based on timing detected by the timing sensor, and detect a thickness of the sheet, in response to the timing detected, based on the signal output from the detection sensor, including starting detecting the thickness of the sheet before a first time when a leading end of the sheet enters the nip portion.

* * * * *